US010886664B2

(12) United States Patent
Sathianathan et al.

(10) Patent No.: US 10,886,664 B2
(45) Date of Patent: Jan. 5, 2021

(54) ELECTRICAL TERMINAL AND CONNECTOR ASSEMBLY

(71) Applicant: Molex, LLC, Lisle, IL (US)

(72) Inventors: Dwaraganathan Bhagyanathan Sathianathan, Rochester Hills, MI (US); Yves Lepottier, Ann Arbor, MI (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/467,495

(22) PCT Filed: Jan. 22, 2018

(86) PCT No.: PCT/US2018/014701
§ 371 (c)(1),
(2) Date: Jun. 7, 2019

(87) PCT Pub. No.: WO2018/136877
PCT Pub. Date: Jul. 26, 2018

(65) Prior Publication Data

US 2020/0006890 A1 Jan. 2, 2020

Related U.S. Application Data

(60) Provisional application No. 62/449,417, filed on Jan. 23, 2017.

(51) Int. Cl.
*H01R 13/52* (2006.01)
*H01R 13/629* (2006.01)
(Continued)

(52) U.S. Cl.
CPC ..... *H01R 13/629* (2013.01); *H01R 9/0518* (2013.01); *H01R 13/18* (2013.01);
(Continued)

(58) Field of Classification Search
CPC .. H01R 13/113; H01R 13/114; H01R 13/642; H01R 13/5205
See application file for complete search history.

(56) References Cited

U.S. PATENT DOCUMENTS 3,363,224 A 1/1968 Gluntz et al.
5,338,229 A 8/1994 Egenolf
(Continued)

FOREIGN PATENT DOCUMENTS

CN 1162853 A 10/1997
CN 1819351 A 8/2006
(Continued)

OTHER PUBLICATIONS

Molex LLC, MQS Interconnection for the Automotive Industry, Catalogue, 2012, p. 1, 25-44, 324, TE Connectivity, Germany.
(Continued)

*Primary Examiner* — Tho D Ta
(74) *Attorney, Agent, or Firm* — Molex, LLC

(57) ABSTRACT

In some embodiments, an electrical terminal includes a contact formed of a first material having a tensile strength, and a hood surrounding the contact, the hood formed of a second material having a tensile strength. The tensile strength of the second material is greater than the tensile strength of the first material. The contact and hood have cooperating retention features for securing the contact to the hood, and the hood provides strengthening features for improving the mechanical properties of the contact. The electrical terminal is mounted in a connector assembly. The electrical terminal has features which prevent or minimize damage to a seal of the connector assembly.

44 Claims, 40 Drawing Sheets

(51) Int. Cl.

| | |
|---|---|
| ***H01R 9/05*** | (2006.01) |
| ***H01R 13/18*** | (2006.01) |
| ***H01R 13/428*** | (2006.01) |
| *H01R 13/11* | (2006.01) |
| *H01R 13/642* | (2006.01) |

(52) U.S. Cl.
CPC ..... *H01R 13/428* (2013.01); *H01R 13/521* (2013.01); *H01R 13/5205* (2013.01); *H01R 13/113* (2013.01); *H01R 13/114* (2013.01); *H01R 13/642* (2013.01)

(56) References Cited

U.S. PATENT DOCUMENTS

| | | | | |
|---|---|---|---|---|
| 5,545,062 | A * | 8/1996 | Takagishi | H01R 13/4223 439/275 |
| 5,658,173 | A * | 8/1997 | Genta | H01R 13/115 439/677 |
| 5,666,723 | A | 9/1997 | Ohtaka et al. | |
| 5,941,741 | A * | 8/1999 | Dobbelaere | H01R 13/113 439/852 |
| 5,954,548 | A | 9/1999 | Stabroth | |
| 5,993,268 | A | 11/1999 | Yamaguchi | |
| 6,062,918 | A * | 5/2000 | Myer | H01R 13/187 439/833 |
| 6,186,840 | B1 * | 2/2001 | Geltsch | H01R 13/18 439/843 |
| 6,203,385 | B1 * | 3/2001 | Sato | H01R 13/113 439/852 |
| 6,860,768 | B2 | 3/2005 | Zhao | |
| D553,080 | S | 10/2007 | Sakamaki et al. | |
| D556,136 | S | 11/2007 | Shiga et al. | |
| 7,311,561 | B2 * | 12/2007 | Anbo | H01R 4/185 439/752.5 |
| 7,594,832 | B2 | 9/2009 | Oka et al. | |
| D621,368 | S | 8/2010 | Lee et al. | |
| 7,976,351 | B2 | 7/2011 | Boemmel et al. | |
| 7,976,353 | B2 | 7/2011 | Myer et al. | |
| 8,858,274 | B2 * | 10/2014 | Jakoplic | H01R 13/11 439/843 |
| 8,974,258 | B2 | 3/2015 | Mitose et al. | |
| 9,378,867 | B2 | 6/2016 | Itou et al. | |
| D762,587 | S | 8/2016 | Ebisawa et al. | |
| D781,239 | S | 3/2017 | Ikeda et al. | |
| 9,705,229 | B2 | 7/2017 | Itou | |
| D827,576 | S | 9/2018 | Sugizaki | |
| D839,212 | S | 1/2019 | Stolze | |
| D847,759 | S | 5/2019 | Bhagyanathan Sathianathan et al. | |
| D847,760 | S | 5/2019 | Bhagyanathan Sathianathan et al. | |
| D847,761 | S | 5/2019 | Bhagyanathan Sathianathan et al. | |
| D853,332 | S | 7/2019 | Chen et al. | |
| D855,574 | S | 8/2019 | Bhagyanathan Sathianathan et al. | |
| 10,389,069 | B2 | 8/2019 | Yamauchi | |
| D870,051 | S | 12/2019 | Endo et al. | |
| D870,675 | S | 12/2019 | Hayashi et al. | |
| 2002/0019167 | A1 | 2/2002 | Koide | |
| 2011/0250805 | A1 | 10/2011 | Nishide | |
| 2014/0141662 | A1 * | 5/2014 | Kutsuna | H01R 13/11 439/888 |
| 2014/0242852 | A1 | 8/2014 | Matsui | |
| 2015/0263456 | A1 | 9/2015 | Hashimoto | |
| 2016/0268701 | A1 | 9/2016 | Nagasaki et al. | |
| 2016/0344115 | A1 | 11/2016 | Miyakawa et al. | |
| 2017/0040728 | A1 | 2/2017 | Saito et al. | |

FOREIGN PATENT DOCUMENTS

| | | | |
|---|---|---|---|
| CN | 104319493 | A | 1/2015 |
| JP | H10-55836 | A | 2/1998 |
| JP | 2003-086281 | A | 3/2003 |
| JP | 2009-117112 | A | 5/2009 |
| JP | 2014-022355 | A | 2/2014 |
| JP | 2015-090786 | A | 5/2015 |
| KR | 10-2016-0145182 | A | 12/2016 |
| TW | D109776 | S | 3/2006 |
| TW | D118533 | S | 8/2007 |
| TW | D168324 | S | 6/2015 |
| TW | D174088 | S | 3/2016 |
| TW | D180905 | S | 1/2017 |
| TW | D187637 | A | 1/2018 |
| WO | 2018/136877 | A1 | 7/2018 |

OTHER PUBLICATIONS

Molex LLC, MCON Tab and Receptacle Contacts, Catalogue, 2016, p. 1-13, 15-38, TE Automotive.
Molex LLC, MCON Interconnection System MCON 0.50mm Contact System, Catalogue, 2014, p. 2, TE Automotive.
Molex LLC, MCON Interconnection System MCON 9.5mm Contact System, Catalogue, 2014, p. 12, TE Automotive.
Molex LLC, MCON Interconnection System MCON 8mm Contact System, Catalogue, 2014, p. 11, TE Automotive.
Notice of Allowance received for U.S. Appl. No. 29/689382, dated Feb. 6, 2020, 7 pages.
International Search Report and Written Opinion received for PCT application No. PCT/US2018/014701, dated May 8, 2018, 15 pages.
International Preliminary Report on Patentability received for PCT Application No. PCT/US2018/014701, dated Aug. 1, 2019, 14 pages.
Office action received for KR patent application No. 10-2019-7020987, dated May 20, 2020, 12 pages. (6 pages of english translation and 6 pages of official copy).
Notification of Reasons for Refusal received for JP application No. 2019-531124, dated Sep. 1, 2020, 12 pages. (7 pages of english translation and 5 pages of official copy).

* cited by examiner

ELECTRICAL TERMINAL AND CONNECTOR ASSEMBLY

RELATED APPLICATIONS

This application claims priority to PCT Application No. PCT/US2018/014701, filed on Jan. 22, 2018, which further claims priority to U.S. Provisional Application No. 62/449,417, filed on Jan. 23, 2017, which are incorporated herein by reference in their entirety.

TECHNICAL FIELD

This disclosure relates to the field of electrical terminals and connector assemblies into which the electrical terminals are mounted.

BACKGROUND ART

In certain conditions, exposure to the environment cannot be avoided and a structure is needed to seal an electrical connection from moisture and debris. In these instances, a sealed system is required which involves providing a moisture resistant barrier between cooperating electrical connectors. Generally, the sealing aspect is disposed between the mating interface of the connectors and, additionally, at the wire end or harness end of each of the connectors. In certain instances, the terminals of the connector may need to be serviced or replaced, which involves removing the terminal from the connector. In these cases, one can appreciate a terminal that can be removed from a connector which does not damage the seal during service.

SUMMARY

In some embodiments, an electrical terminal includes a contact formed of a first material having a tensile strength, and a hood surrounding the contact, the hood formed of a second material having a tensile strength. The tensile strength of the second material is greater than the tensile strength of the first material. The contact and hood have cooperating retention features for securing the contact to the hood, and the hood provides strengthening features for improving the mechanical properties of the contact. The electrical terminal is mounted in a connector assembly. The electrical terminal has features which prevent or minimize damage to a seal of the connector assembly.

In an embodiment, an electrical terminal includes a contact formed of a first material having a tensile strength, and a hood surrounding the contact, the hood formed of a second material having a tensile strength. The tensile strength of the second material is greater than the tensile strength of the first material. The contact includes first and second contact beams which are movable relative to a body. The hood includes first and second and second stiffening beams which are movable relative to a body. The stiffening beams have a length which is less than the length of the contact beams.

In an embodiment, an electrical terminal includes a contact formed of a first material having a tensile strength, and a hood surrounding the contact, the hood formed of a second material having a tensile strength. The tensile strength of the second material is greater than the tensile strength of the first material. The contact includes first and second contact beams which are movable relative to a body. The hood includes first and second and second stiffening beams which are movable relative to a body and an alignment rib extending from the body. A front end of the alignment rib is spaced rearwardly from a front end of the body of the hood.

In an embodiment, an electrical terminal includes a contact formed of a first material having a tensile strength, and a hood surrounding the contact, the hood formed of a second material having a tensile strength. The tensile strength of the second material is greater than the tensile strength of the first material. The contact includes first and second contact beams which are movable relative to a body. The hood includes first and second and second stiffening beams which are movable relative to a body. A plurality of flanges extend from a front end of the body of the hood. The edges of the wall and the flanges are formed from chamfered surfaces.

In an embodiment, a combination of a connector assembly and an electrical terminal is provided. The connector assembly includes a housing, a compliant resilient seal rearward of the housing, and a grommet cap rearward of the seal. A passageway in the grommet cap has a front passageway portion which forms a first dimension of the passageway, and a rear passageway portion extending which forms a second dimension of the passageway, the first dimension being greater than the second dimension. The electrical terminal includes a contact having first and second contact beams extending from a body. The contact is seated within the housing and is forward of the seal.

In an embodiment, a combination of a connector assembly and an electrical terminal is provided. The connector assembly includes a housing, a lock configured to be locked in position relative to the housing and configured to be movable relative to the housing, a front end of the lock having surfaces which are angled, a compliant resilient seal rearward of the housing and the lock, and a grommet cap rearward of the seal. The electrical terminal includes a contact having first and second contact beams extending from a body, and a hood surrounding the contact. The hood is seated within the housing and forwardly of the seal. The hood has mating angled surfaces which mate with the angled surfaces on the lock.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

DETAILED DESCRIPTION OF THE PREFERRED EMBODIMENTS

Figure 1:
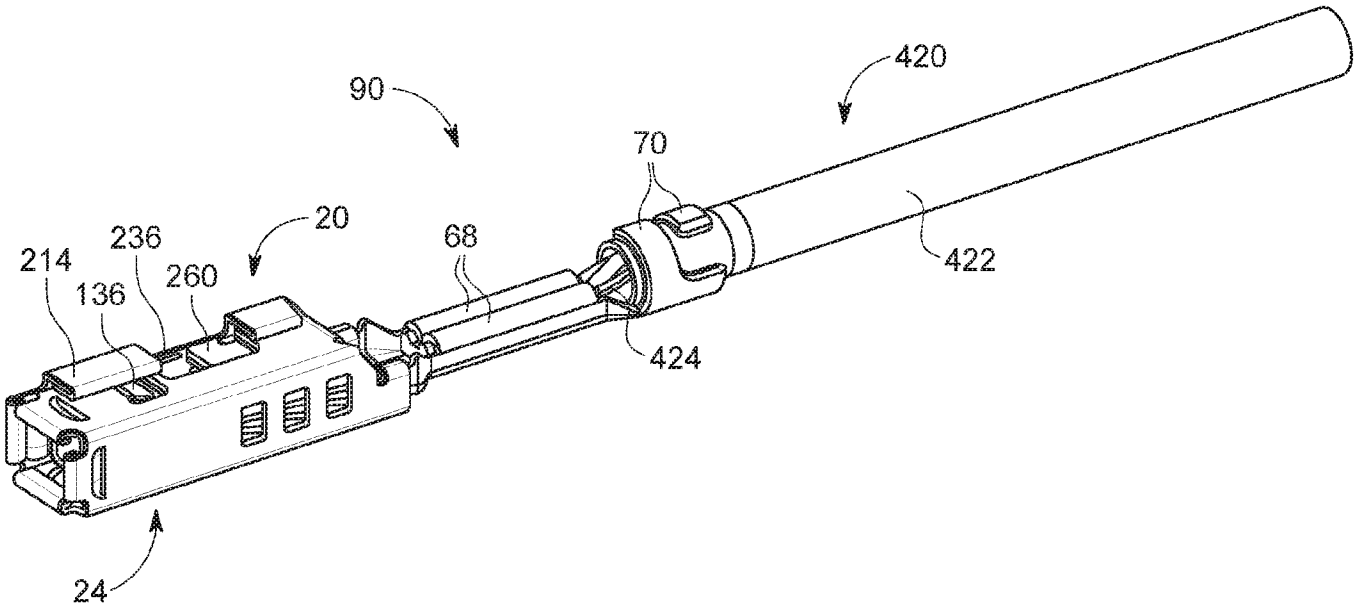
FIG. 1 is a front perspective view of a connector assembly and contact assembly coupled together.

The drawings illustrate an embodiment of the present disclosure and it is to be understood that the disclosed embodiment is merely exemplary of the disclosure, which may be embodied in various forms. Therefore, specific details disclosed herein are not to be interpreted as limiting, but merely as a basis for the claims and as a representative basis for teaching one skilled in the art to variously employ the present disclosure.

The present disclosure is directed to an electrical terminal 20 which mates with a connector assembly 620. The drawings illustrate a single circuit of the connector assembly 620 such that the illustrations for each element of the connector assembly 620 are a single slice or portion of the entire connector assembly 620; multiple circuits are provided to form the complete connector assembly 620. It should also be noted that directions such as "front", "rear", "top", "upper", "bottom" and "lower", etc. are used herein for convenience in description, do not denote a required orientation during use, are arbitrary, and are used to provide a clearer understanding of the embodiments shown.

The electrical terminal 20 is constructed from two separate pieces, a first piece or contact 22 and a second piece or hood 24. The two-part construction provides a smaller electrical terminal 20 while providing increased performance. The contact 22 is stamped and formed from a single piece of a highly conductive material, such as copper or any other copper based alloy or similar material having the same electrical conducting properties, allowing for superior electrical performance. The hood 24 is stamped and formed from a single piece of sheet metal formed of a high strength tensile material, such as stainless steel, to provide superior retention force and reinforcement. The tensile strength of the material forming the hood 24 is greater than the tensile strength of the material forming the contact 22. The electrical terminal 20 receives a corresponding male terminal 320, such as a pin or blade. Steel provides additional benefits to copper or copper based alloys. Steel typically exhibits higher tensile strength properties and situations where it is used in spring or biasing applications is a superior choice. The contact 22 and the hood 24 are formed separately, and are secured together via a separate assembly or marriage die.

In the embodiment, the following description is directed to the electrical terminal 20 having an electrical lead wire 420 attached thereto. The lead wire 420 has an insulative covering 422 over conductors 424 as is known in the art. The insulative covering 422 is partially removed at a leading end of the lead wire 420 to expose the conductors 424 provided therein.

The contact 22 is best shown in FIGS. 9-12. The contact 22 has a contact portion 26 which is configured to provide an electrical connection to the corresponding male terminal 320, a wire securing portion 28 which is configured to be coupled to the lead wire 420, and a transition portion 30 which connects the contact portion 26 to the wire securing portion 28.

The contact portion 26 is formed of a body 32 having opposite front and rear ends 32*a*, 32*b* and having a passageway 34 formed therethrough which extends from the front end 32*a* to the rear end 32*b*, and first and second cantilevered spring arms or contact beams 36, 38 extending from the body 32 and into the passageway 34. All edges forming the front and rear ends 32*a*, 32*b* are chamfered to provide surfaces which angle inwardly toward the passageway 34; the edges may be rounded; the edges are smoothed to remove burrs in the metal. A centerline 40 is defined along the length of the body 32 from the front end 32*a* to the rear end 32*b*. The body 32 is formed of opposite top and bottom walls 42, 44 which are separated from each other by first and second upright side walls 46, 48 to form the passageway 34. Interior and exterior surfaces of each wall 42, 44, 46, 48 are planar. Front edges 42*a*, 44*a*, 46*a*, 48*a* of the walls 42, 44, 46, 48 form an entrance opening 50 into the passageway 34. The front edges 42*a*, 44*a*, 46*a*, 48*a* are chamfered to provide surfaces which angle inwardly toward the passageway 34; the edges 42*a*, 44*a*, 46*a*, 48*a* may be rounded; the edges 42*a*, 44*a*, 46*a*, 48*a* are smoothed to remove burrs in the metal.

A top opening 52 is formed in the top wall 42 proximate to, but spaced from, the front end 32*a* of the body 32 and is formed from a front edge 52*a*, a rear edge 52*b* and side edges extending between the front and rear edges 52*a*, 52*b*. At least the rear edge 52*b* is chamfered to provide surfaces which angle inwardly toward the passageway 34; the edges may be rounded; the edges are smoothed to remove burrs in the metal. A bottom opening 54 is formed in the bottom wall 44 proximate to, but spaced from, the front end 32*a* of the body 32 and is formed from a front edge 54*a*, a rear edge 54*b* and side edges extending between the front and rear edges 54*a*, 54*b*. At least the rear edge 54*b* is chamfered to provide surfaces which angle inwardly toward the passageway 34; the edges may be rounded; the edges are smoothed to remove burrs in the metal. In an embodiment, the openings 52, 54 are vertically aligned.

The contact beam 36 extends rearwardly from the forward edge 52*a* of the top opening 52 rearwardly, through the top opening 52 and into the passageway 34. The contact beam 38 extends rearwardly from the forward edge 54*a* of the bottom opening 54, through the bottom opening 52 and into the passageway 34. The contact beams 36, 38 are configured to electrically engage the mating male terminal 320. In an embodiment, each contact beam 36, 38 has a front end connected to the respective forward edge 52*a*, 54*a*, a front section 56 which extends rearwardly from the forward edge 52*a*, 54*a* and curves inwardly relative to the centerline 40, an intermediate section 58 which extends rearwardly from the front section 56 and is angled inwardly relative to the centerline 40 and relative to the front section 56, and a rear section 60 which extends rearwardly from the intermediate section 58 and curves inwardly and then outwardly relative to the centerline and relative to the intermediate section 58. The rear section 60 terminates in a free rear end 60*a*. Each contact beam 36, 38 has a length which is defined from the forward edge 52*a*, 54*a* to the rear end 60*a*. In an embodiment, the lengths are the same. In an embodiment, the contact beams 36, 38 are vertically aligned with each other.

In an embodiment, a dimple 62 is provided on an interior surface of each side wall 46, 48 forwardly of the forward edge 52*a*, 54*a* of the openings 52, 54. The dimples 62 may have a dome shape.

A plurality of spaced apart protrusions 64 extend outwardly from the exterior surface of the side walls 46, 48 and are rearward of the openings 52, 54. As shown, three protrusions 64 are provided, although more or fewer protrusions 64 may be provided. In an embodiment, each projection 64 has a rear face 64*a* which extends perpendicular to the centerline 40.

A rear end 42*b* of the top wall 42 is longitudinally spaced from the rear end 32*b* of the body 32. An upper portion of each rear end 46*b*, 48*b* of the side walls 46, 48 extends at an angle downwardly and rearwardly from the rear end 42*b* of the top wall 42 to the rear end 32*b* of the body 32. The edges 42*b*, 46*b*, 48*b* are chamfered to provide surfaces which angle inwardly toward the passageway 34; the edges 42*b*, 46*b*, 48*b* may be rounded; the edges 42*b*, 46*b*, 48*b* are smoothed to remove burrs in the metal.

The wire securing portion 28, in an embodiment, is generally U-shaped. The wire securing portion 28 is configured to receive the electrical lead wire 420. The wire securing portion 28 includes a curved base wall 66 having front and rear ends 66*a*, 66*b*, wire crimp portions 68 extending upwardly from the base wall 66 and configured to connect to the exposed conductors 424 of the lead wire 420, and insulation crimp portions 70 extending upwardly from the base wall 66 and configured to connect to the insulative covering 422 of the lead wire 420. The base wall 66 is sized to accommodate the exposed conductors 424 and the insulative covering 422 of the electrical lead wire 420. The wire crimp portions 68 are forward of the insulation crimp portions 70. In an embodiment, the wire crimp portions 68 are formed as wings extending upwardly from the base wall 66, and the insulation crimp portions 70 are formed as wings extending upwardly from the base wall 66.

To connect the lead wire 420 to the wire securing portion 28, a front portion of the insulative covering 422 is removed to expose the conductors 424. The bare conductors 424 are placed within the base wall 66 below the wire crimp portions 68 and a portion of the lead wire 420 having the intact insulative covering 422 is placed within the base wall 66 below the insulation crimp portions 70. The portions 68, 70 are then folded over the respective portions of the lead wire 420 to secure the lead wire 420 to the contact 22, with the wire crimp portions 68 securing or crimping the contact 22 to the bare conductors 424 and the insulation crimp portions 70 securing or crimping the insulative covering 422 to the contact 22.

The transition portion 30 of the electrical terminal 20 extends between the contact portion 26 and the wire securing portion 28. The transition portion 30 has a generally U-shaped base wall 72 having side walls 74, 76 extending upwardly therefrom. A front portion 78 of each side wall 74, 76 extends longitudinally and a rear portion 80 of each side wall 74, 76 extends at an angle inwardly toward the centerline 40 from the front portion 78 to the wire securing portion 28. A top edge of each front portion 78 forms a notch 82 having a front surface 84 extending downwardly from the bottom end of the respective rear edge 46*b*, 48*b*, a planar intermediate surface 86 which extends longitudinally, and a rear surface 88 extending upwardly from the rear end of the respective intermediate surface 86 to the rear portion 80.

When the electrical terminal 20 and the lead wire 420 are connected together, a contact assembly 90 is formed.

Figure 19:
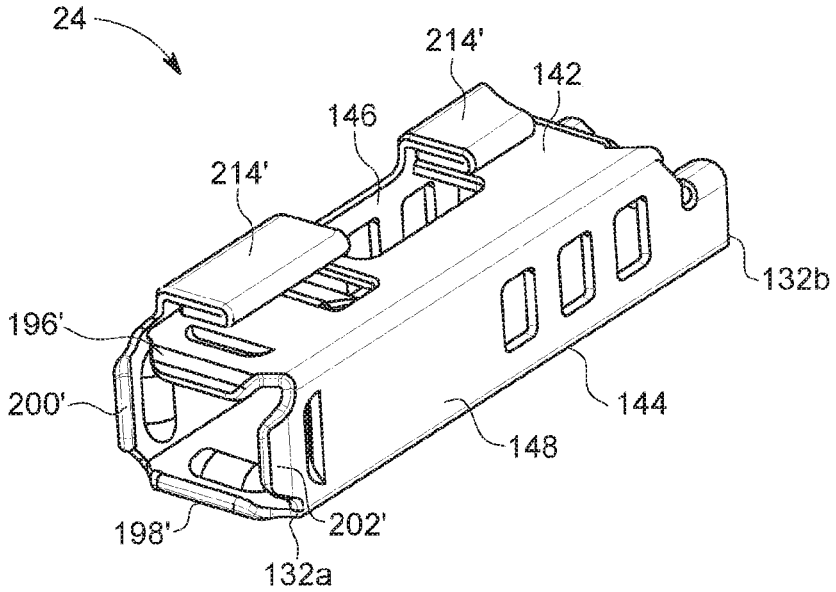
FIG. 19 is a front perspective view of an alternate embodiment of the hood.
Figure 20:
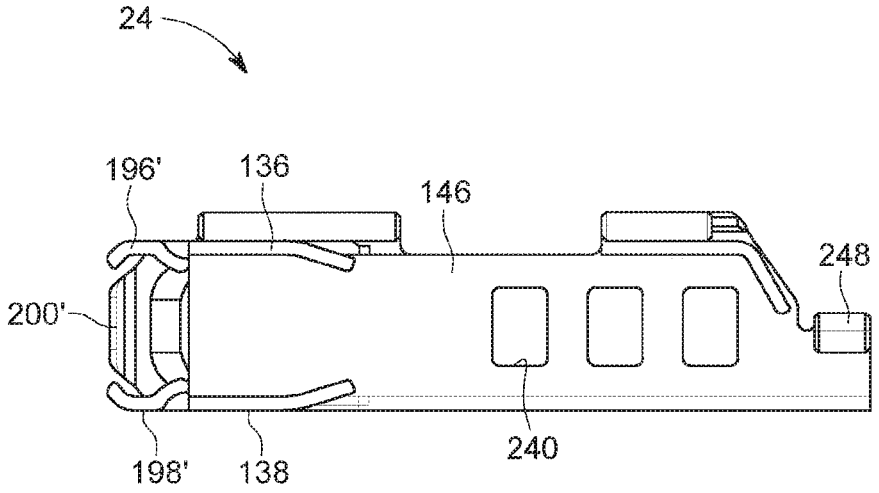
FIG. 20 is a cross-sectional view of the hood of FIG. 19.
Figure 21:
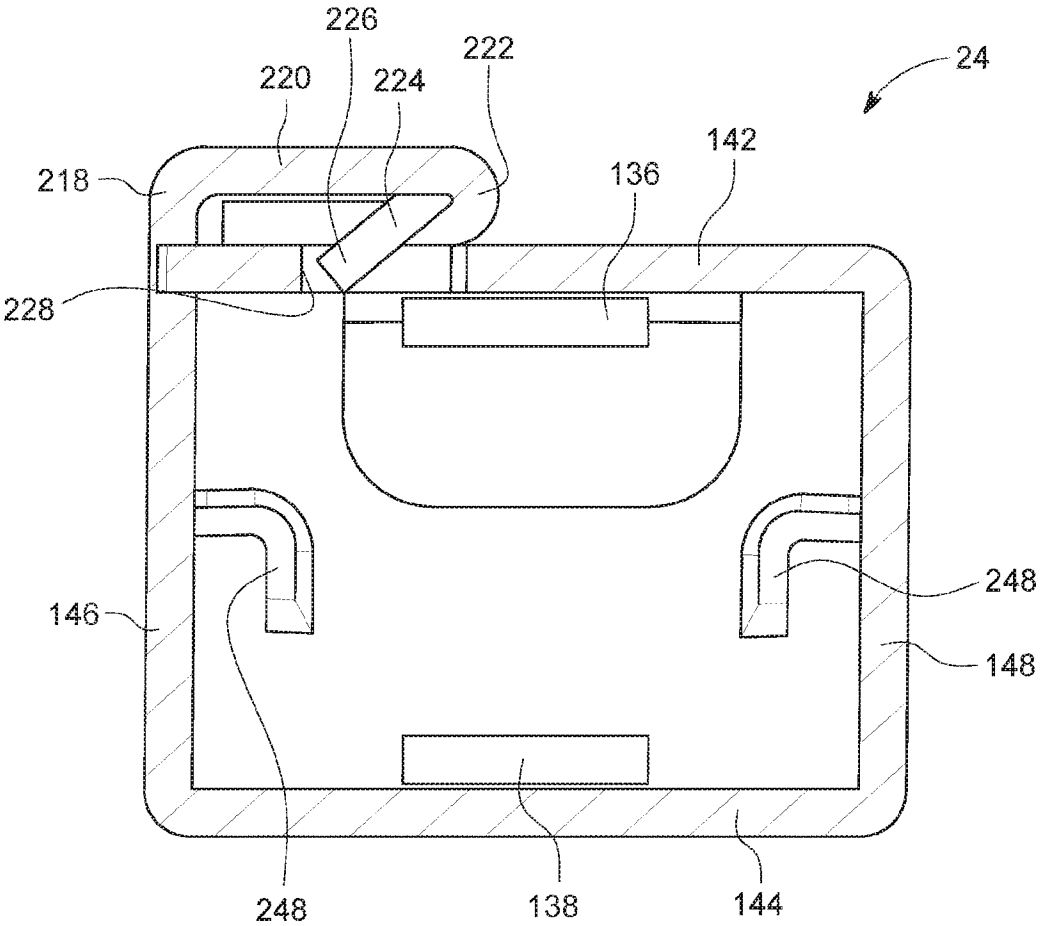
FIG. 21 is an alternate cross-sectional view of the hood of FIG. 19.
Figure 22:
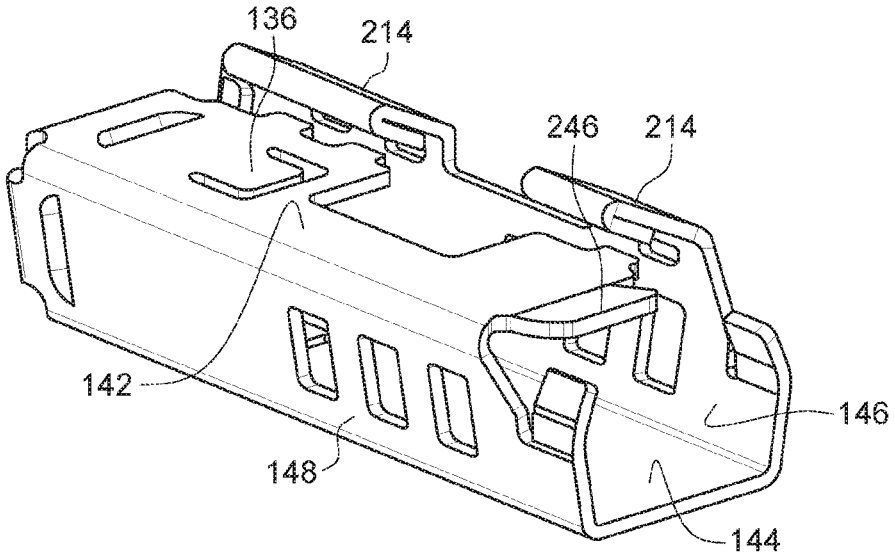
FIG. 22 is a rear perspective view of the hood of FIG. 19 shown in a partially formed condition.
Figure 23:
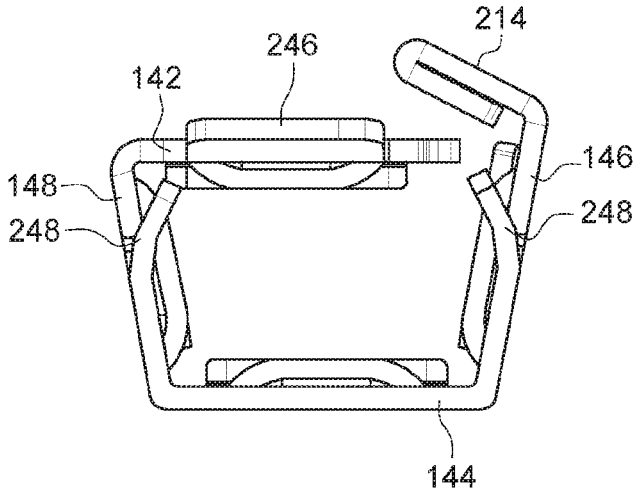
FIG. 23 is a front elevation view of the hood of FIG. 19 shown in the partially formed condition.
Figure 24:
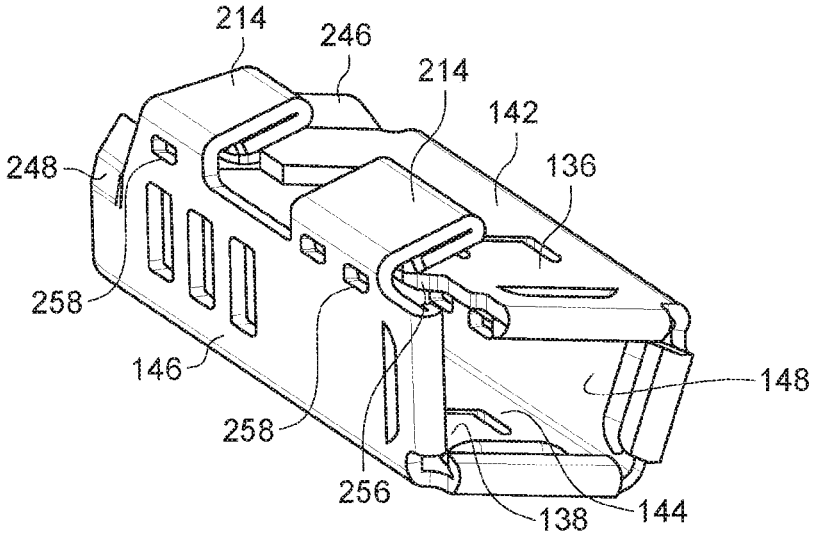
FIG. 24 is a front perspective view of the hood of FIG. 19 shown in the partially formed condition.
Figure 25:
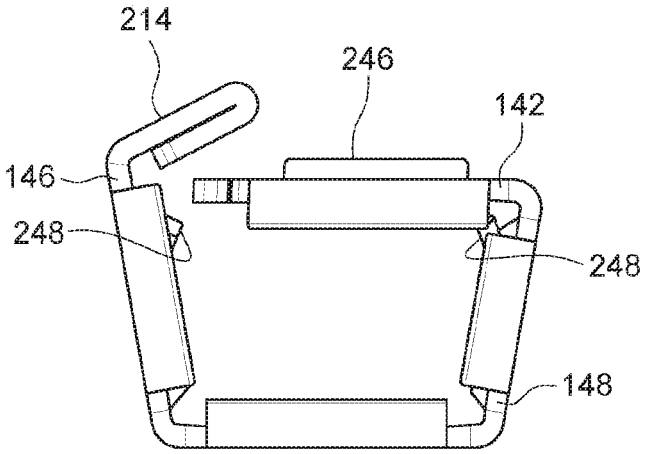
FIG. 25 is a front elevation view of the hood of FIG. 19 shown in the partially formed condition.
Figure 26:
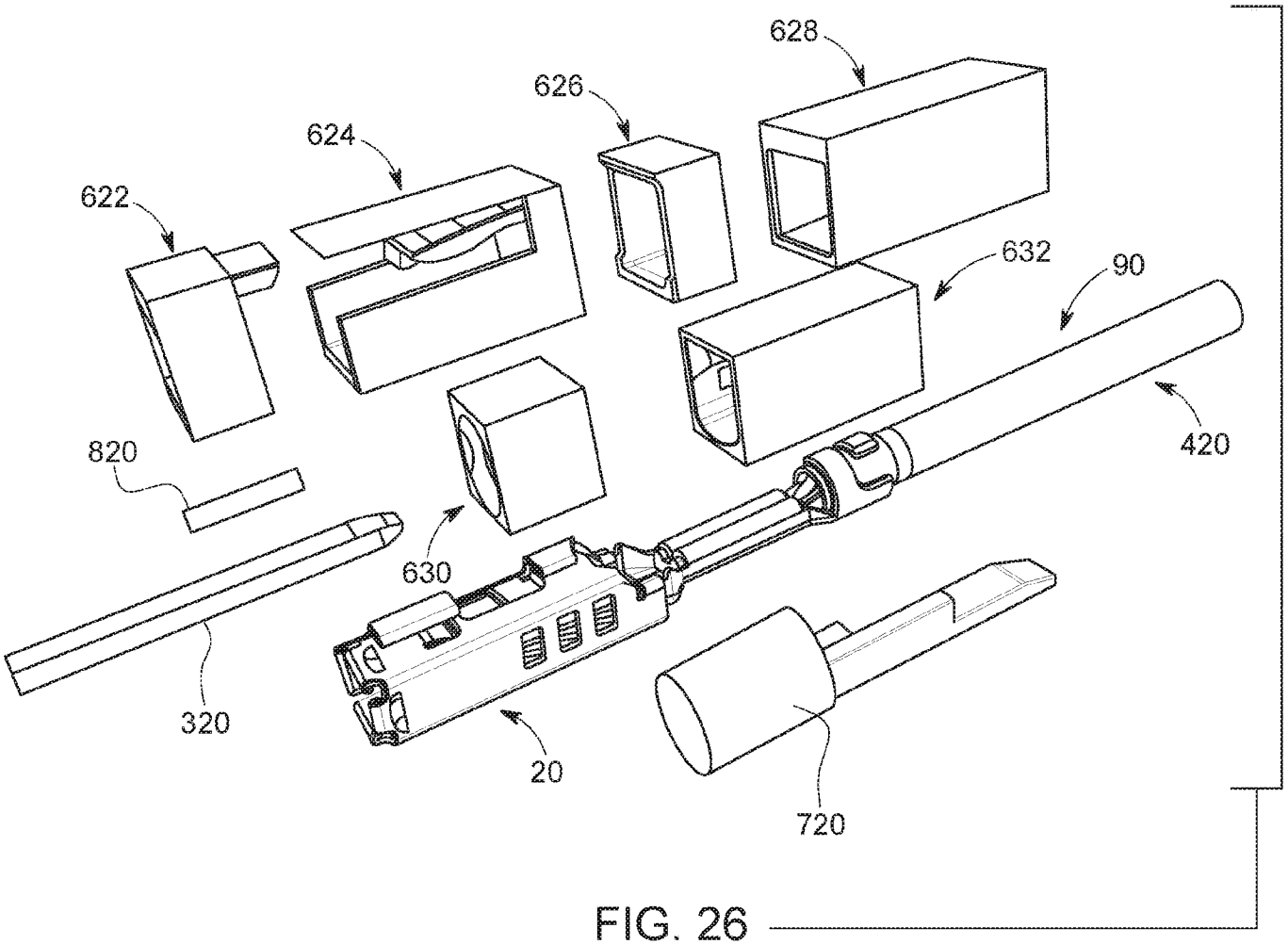
FIG. 26 is a front perspective view of the connector assembly, the contact assembly, a male terminal, a retracting tool and a probe, shown exploded from each other.
Figure 27:
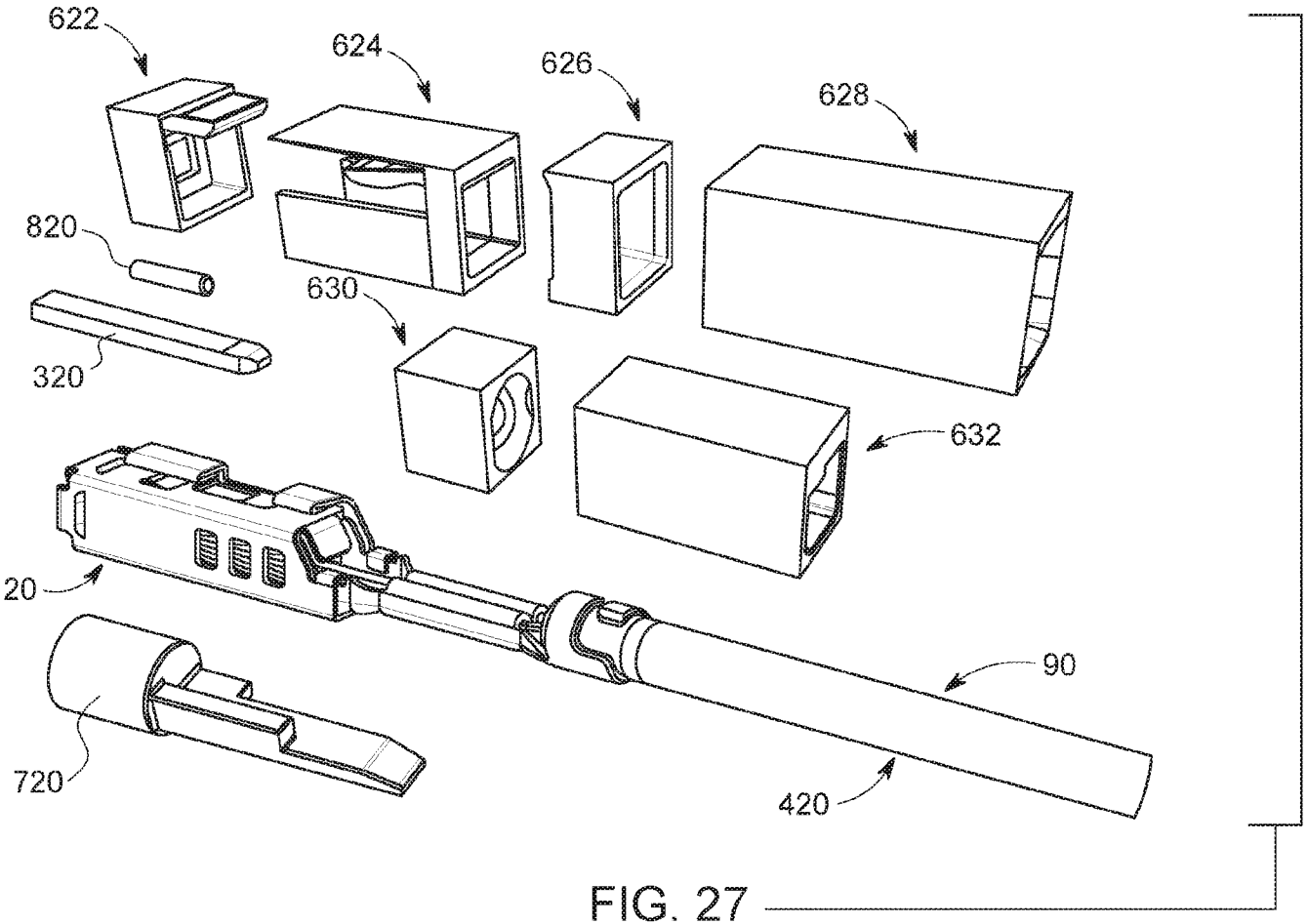
FIG. 27 is a rear perspective view of the connector assembly, the contact assembly, the male terminal, the retracting tool and the probe, shown exploded from each other.
Figure 28:
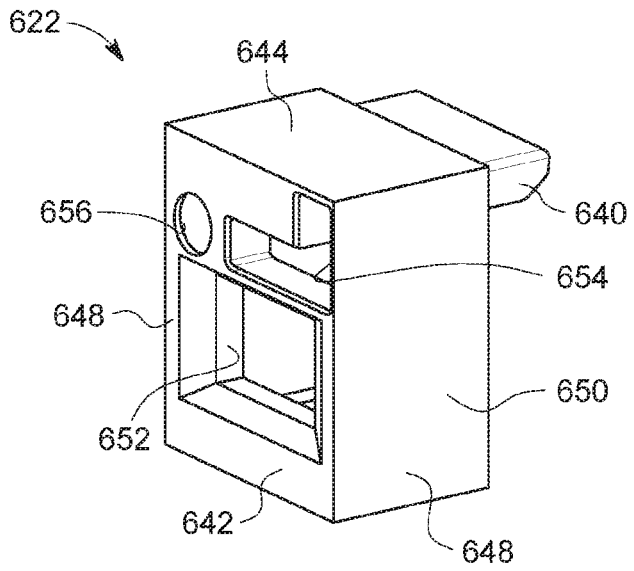
FIG. 28 is a front perspective view of a front cover of the connector assembly.
Figure 29:
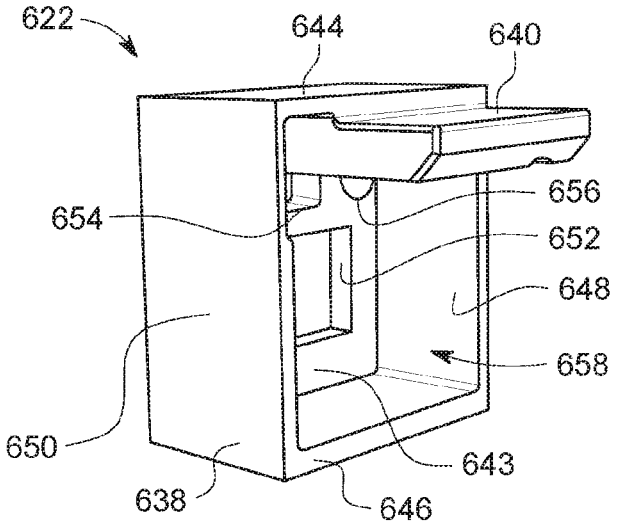
FIG. 29 is a rear perspective view of the front cover.
Figure 30:
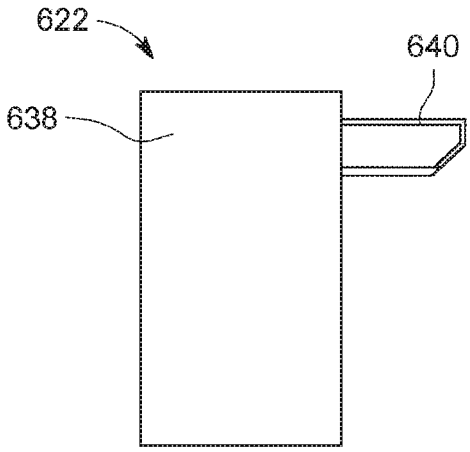
FIG. 30 is a side elevation view of the front cover.
Figure 31:
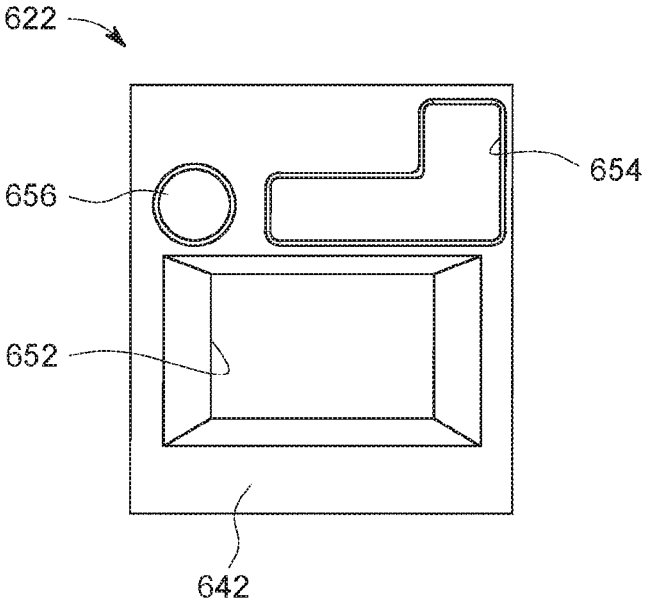
FIG. 31 is a front elevation view of the front cover.

A first embodiment of the hood 24 is best shown in FIGS. 13-18, and a second embodiment of the hood 24 is best shown in FIGS. 19-21. The hood 24 is formed of a body 132 having opposite front and rear ends 132*a*, 132*b* and having a passageway 134 formed therethrough which extends from the front end 132*a* to the rear end 132*b*, and first and second cantilevered stiffening beams 136, 138 extending from the body 132 and into the passageway 134. All edges forming the front and rear ends 132*a*, 132*b* are chamfered to provide surfaces which angle inwardly toward the passageway 134; the edges may be rounded; the edges are smoothed to remove burrs in the metal. A centerline 140 is defined along the length of the body 132 from the front end 132*a* to the rear end 132*b*. The body 132 is formed of opposite top and bottom walls 142, 144 which are separated from each other by first and second upright side walls 146, 148 to form the passageway 134. Interior and exterior surfaces of each wall 142, 144, 146, 148 are planar. A top opening 152 is formed in the top wall 142 and is formed from a front edge 152*a*, a rear edge 152*b* and side edges 152*c*, 152*d* extending between the front and rear edges 152*a*, 152*b*. The edges 152*a*, 152*b*, 152*c*, 152*d* are chamfered to provide surfaces which angle inwardly toward the passageway 134; the edges may be rounded; the edges are smoothed to remove burrs in the metal. A bottom opening 154 is formed in the bottom wall 144 proximate to, but spaced from, the front end 132*a* of the body 132 and is formed from a front edge 154*a*, a rear edge 154*b* and side edges 154*d* (only one of which is shown) extending between the front and rear edges 154*a*, 154*b*. The edges 154*a*, 154*b*, 154*d* (and other side edge) are chamfered to provide surfaces which angle inwardly toward the passageway 134; the edges may be rounded; the edges are smoothed to remove burrs in the metal. In an embodiment, the openings 152, 154 are vertically aligned.

The stiffening beam 136 extends rearwardly from the forward edge 152*a* of the top opening 152, through the top opening 152 and into the passageway 134. The stiffening beam 138 extends rearwardly from the forward edge 154*a* of the bottom opening 154, through the bottom opening 152 and into the passageway 134. The stiffening beams 136, 138 are configured to engage the contact beams 36, 38 of the contact 22 to provide reinforcement of the contact beams 36, 38. In an embodiment, each stiffening beam 136, 138 has a front end connected to the respective forward edge 152*a*, 154*a* and a section 192 which extends rearwardly from the forward edge 152*a*, 154*a* and is angled inwardly relative to the centerline 140. The section 192 terminates in a free rear end 192*a*. Each stiffening beam 136, 138 has a length which is defined from the forward edge 152*a*, 154*a* to the rear end 192*a*. In an embodiment, the lengths are the same. In an embodiment, the stiffening beams 136, 138 are vertically aligned with each other. At least the side edges forming the stiffening beams 136, 138 are chamfered to provide surfaces which angle inwardly toward the passageway 134; the edges may be rounded; the edges are smoothed to remove burrs in the metal. The length of each stiffening beam 136, 138 is less than the length of the respective contact beam 36, 38. In an embodiment, each stiffening beam 136, 138 has a length which is less than the combined lengths of the front and intermediate sections 56, 58 of the contact beams 36, 38. In an embodiment, each stiffening beam 136, 138 has a length which is substantially equal to the combined lengths of the front and intermediate sections 56, 58 of the contact beams 36, 38.

Figure 13:
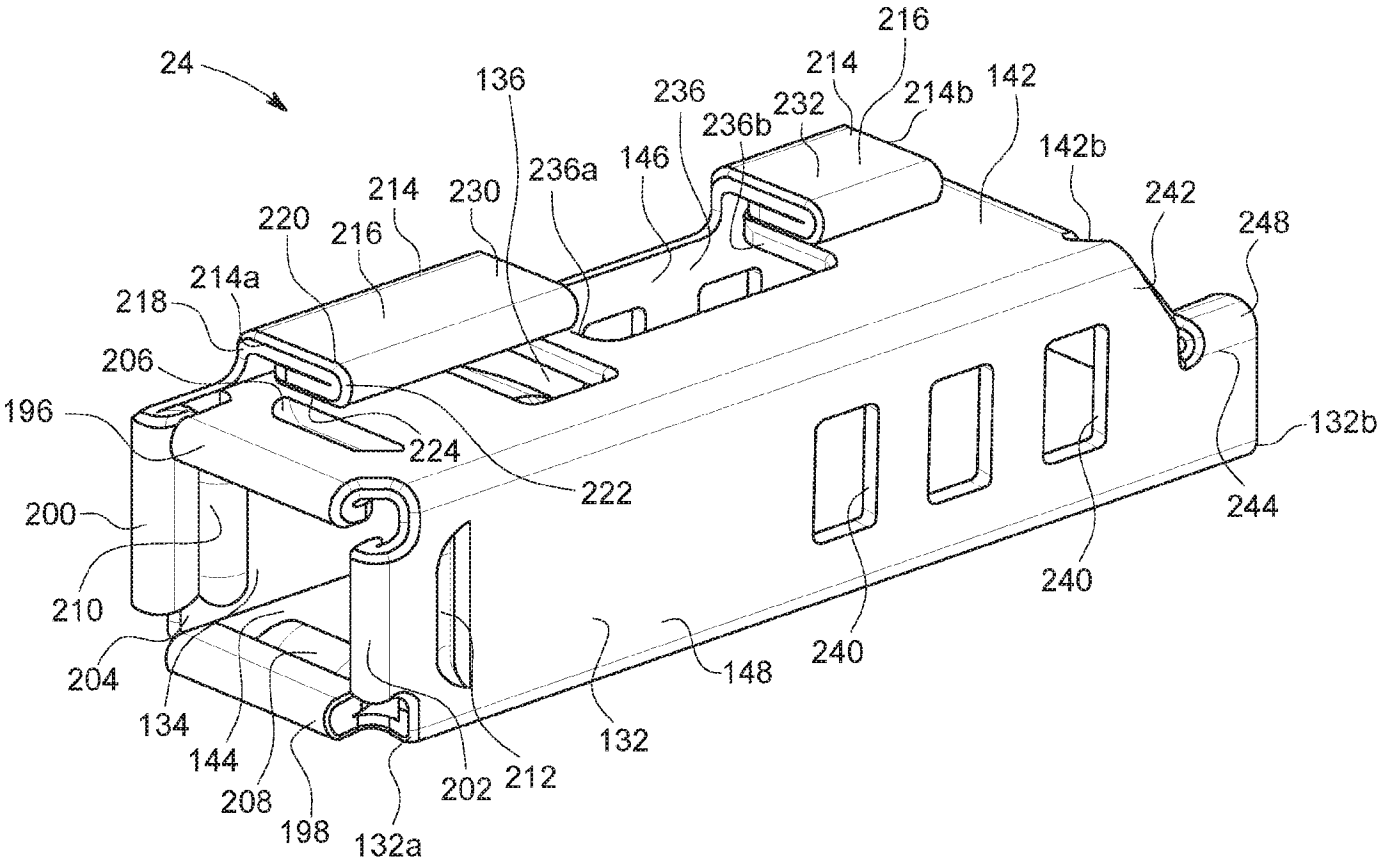
FIG. 13 is a front perspective view of an embodiment of the hood.
Figure 14:
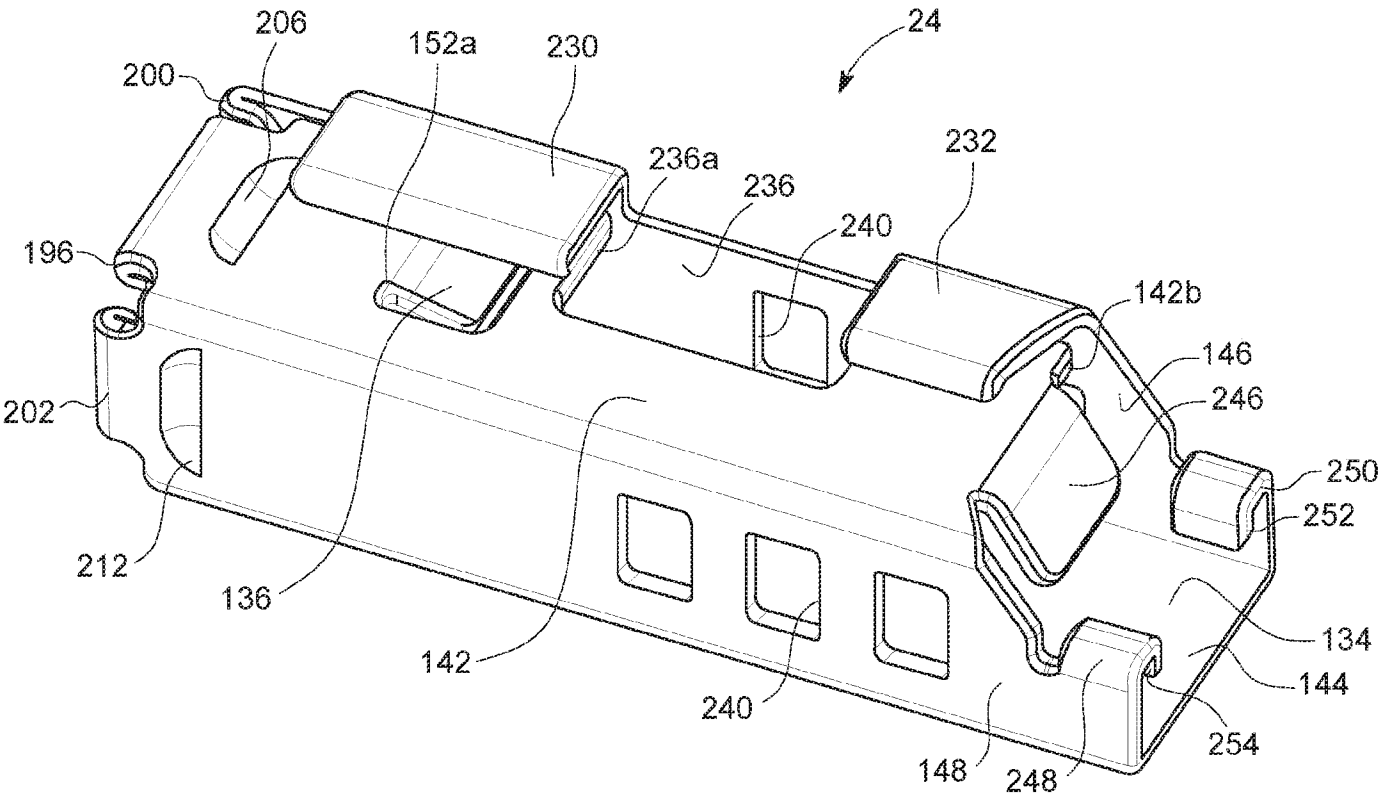
FIG. 14 is a rear perspective view of the hood of FIG. 13.
Figure 18:
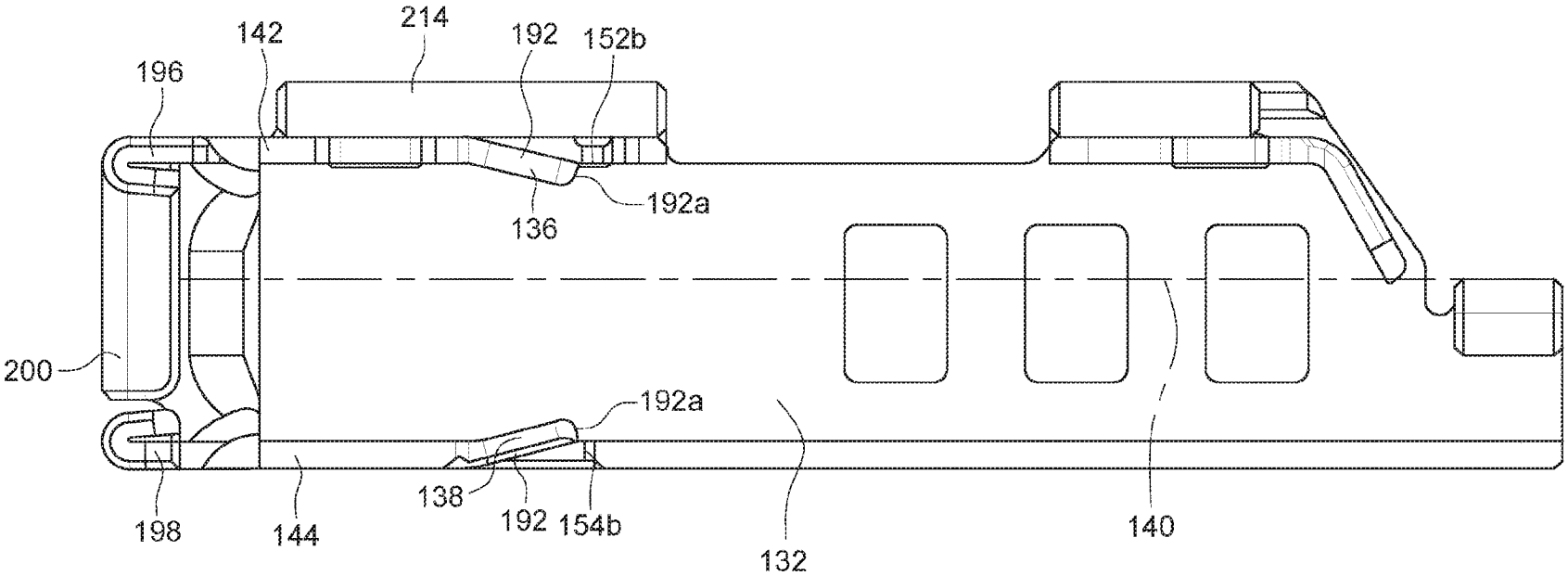
FIG. 18 is a cross-sectional view of the hood of FIG. 13.
Figure 18A:
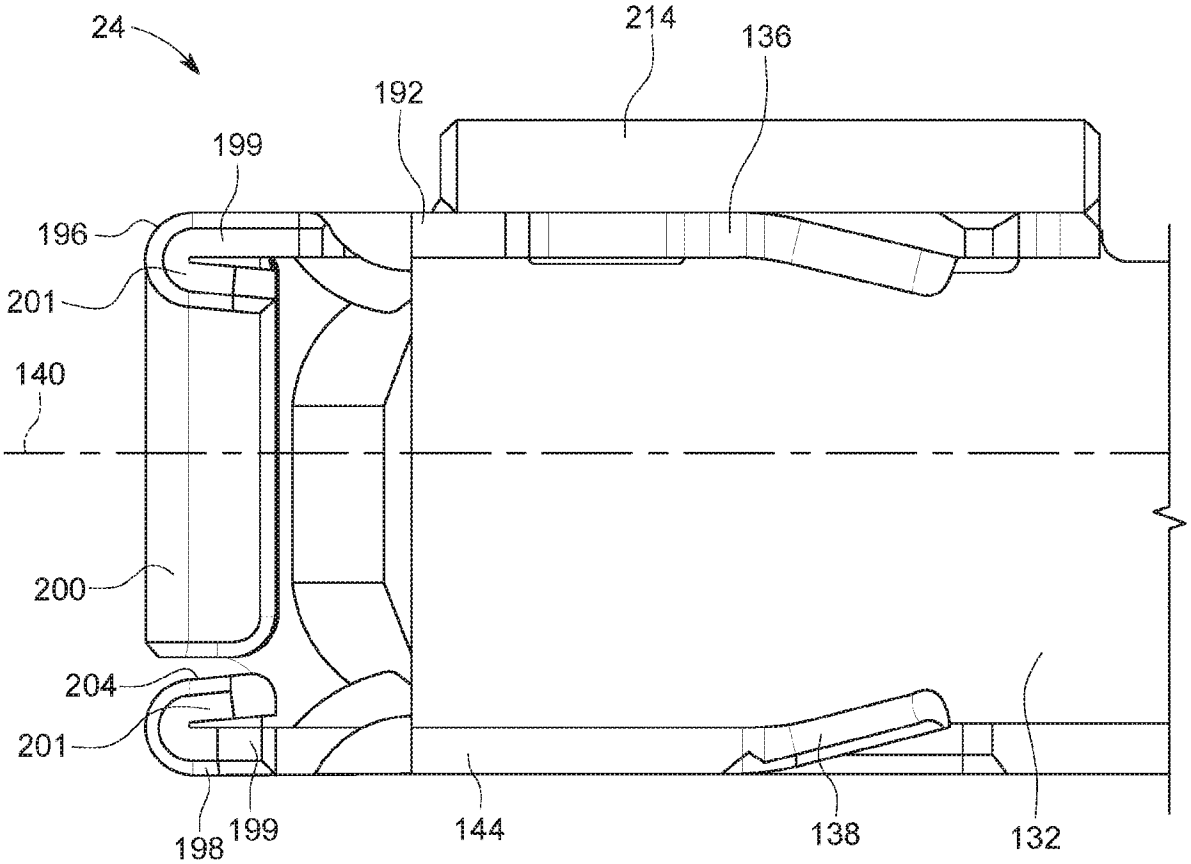
FIG. 18A is a partial cross-sectional view of the hood of FIG. 13.
Figure 20A:
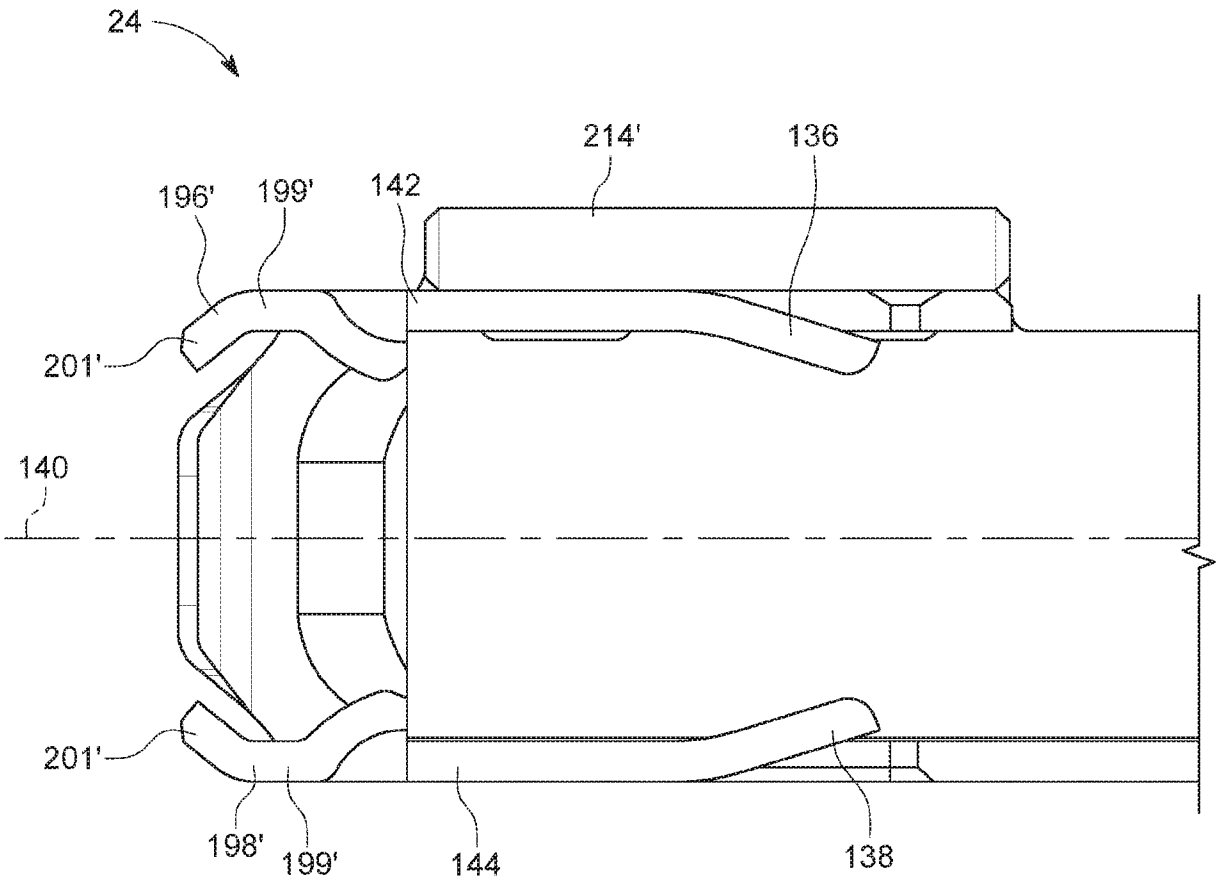
FIG. 20A is a partial cross-sectional view of the hood of FIG. 19.

In an embodiment, a flange 196, 196', 198, 198', 200, 200', 202, 202' extends from the respective wall 142, 144, 146, 148 at the front end 132*a* of the body 132 and defines an entrance opening 204 into the passageway 134. In an embodiment as shown in FIGS. 13, 14 and 18A, flanges 196, 198 have widths which are less than the widths of the top and bottom walls 142, 144, and the flanges 200, 202 have heights which less than the heights of the first and second side walls 146, 148, and each flange 196, 198, 200, 202 is formed of two wall portions 199, 201. Wall portion 199 extends outwardly the respective wall 142, 144, 146, 148, is planar therewith and parallel to the centerline 140, and wall portion 199 is bent inwardly toward the centerline 140 and then bent rearwardly. In an embodiment, each wall portion 201 is angled at an angle of about 120 degrees to about 180 degrees relative to a centerline of the first wall portion 199. In another embodiment as shown in FIGS. 19, 20 and 20A, flanges 196', 198' have widths which are less than the widths of the top and bottom walls 142, 144, and the flanges 200', 202' have heights which are less than the heights of the first and second side walls 146, 148, and each flange 196', 198', 200', 202' is formed of two wall portions 199', 201'. Wall portion 199' extends outwardly the respective wall 142, 144, 146, 148, is planar therewith and parallel to the centerline 140. Wall portion 199' is bent inwardly toward the centerline 140. In an embodiment, each wall portion 201 is angled at an angle of about 15 degrees to about 75 degrees relative to a centerline of the first wall portion 199. In an embodiment, the second wall portion 201 has a curved shape. The edges forming the flanges 196, 196', 198, 198', 200, 200', 202, 202' are chamfered to provide surfaces which angle inwardly toward the entrance opening 204 and the passageway 134; the edges may be rounded; the edges are smoothed to remove burrs in the metal.

A projection 206, 208, 210, 212 extends inwardly from the respective wall 142, 144, 146, 148 proximate to the front end 132*a* of the body 132 and into the passageway 134. The projections 206, 208, 210, 212 act as forward stops when the contact 22 is inserted into the hood 24 as described herein. In an embodiment, each projection 206, 208, 210, 212 has a rear face which extends perpendicular to the centerline 140.

An alignment rib 214, 214' extends upwardly from the top wall 142 and overlaps a portion of the top wall 142. In an embodiment, the alignment rib 214, 214' overlaps a portion of the top opening 152 and the stiffening beam 136. The alignment rib 214, 214' has front and rear ends 214*a*, 214*b* and a planar top surface 216. All edges forming the front and rear ends 214*a*, 214*b* are chamfered to provide surfaces which angle inwardly toward the entrance opening 204 and the passageway 134; the edges may be rounded; the edges are smoothed to remove burrs in the metal. In an embodiment, the rear end 214*b* angles downwardly relative to the centerline 140 of the body 132 and outwardly away from the front end 132*a* of the body 132.

In an embodiment, the alignment rib 214 is formed of a folded over wall formed of a first wall portion 218 extending upwardly from the side wall 146, a second wall portion 220 extending from the top end of the first wall portion 218 and inwardly from the first wall portion 218, a third wall portion 222 extending from the end of the second wall portion 220 and forming a 180-degree bend, and a fourth wall portion 224 extending from the end of the third wall portion 222 and outwardly toward the first wall portion 218, such that the second wall portion 216 overlays the fourth wall portion 224. In an embodiment as shown in FIGS. 19-21, the alignment rib 214' is formed of the folded over wall portions 218, 220, 224, 222 and further including a fifth wall portion 226 which forms a retention finger. The fifth wall portion 226 extends from the outer end of the fourth wall portion 224 and at an angle relative thereto such that the fifth wall portion 226 extends inwardly toward the centerline 140. In use, the fifth wall portion 226 seats within a window 228 in the top wall 142 which is sized to receive the fifth wall portion 226. In an embodiment, the fifth wall portion 226 has a longitudinal length which is less than the longitudinal length of the walls portions 218, 220, 224, 222.

In an embodiment, the alignment rib 214, 214' includes front and rear sections 230, 232 which are spaced apart from each other by a space 234 and a window 236 is provided through the top wall 142 and aligns with the space 232. The window 236 is formed by front and rear edges 236*a*, 236*b*, with side edges 236*c*, 236*d* extending therebetween. All edges 236*a*, 236*b*, 236*c*, 236*d* are chamfered to provide surfaces which angle inwardly toward the entrance opening 204 and the passageway 134; the edges may be rounded; the edges are smoothed to remove burrs in the metal. A front end 230*a* of the front section 230 is proximate to, but spaced from, the front end 132*a* of the body 132 such that a space 238 is provided forward of the alignment rib 214, 214' and a rear end 230*b* of the of the front section 230 is proximate to a front end 236*a* of the window 236. In an embodiment, the front end 230*a* is perpendicular to the centerline 140 of the body 132. A front end 232*a* of the rear section 232 is proximate to the rear edge 236*b* of the window 236, and a rear end 232*b* of the of the rear section 232 is proximate to, but spaced from, the rear end 132*b* of the body 132. In an embodiment, the front end 232*a* is perpendicular to the centerline 140 of the body 132. In an embodiment, the rear end 232*a* of the rear section 232 angles downwardly relative to the centerline 140 of the body 132 and outwardly away from the front end 132*a* of the body 132. All edges forming the front and rear sections 230, 232 are chamfered to provide surfaces which angle inwardly toward the entrance opening 204 and the passageway 134; the edges may be rounded; the edges are smoothed to remove burrs in the metal.

Figure 15:
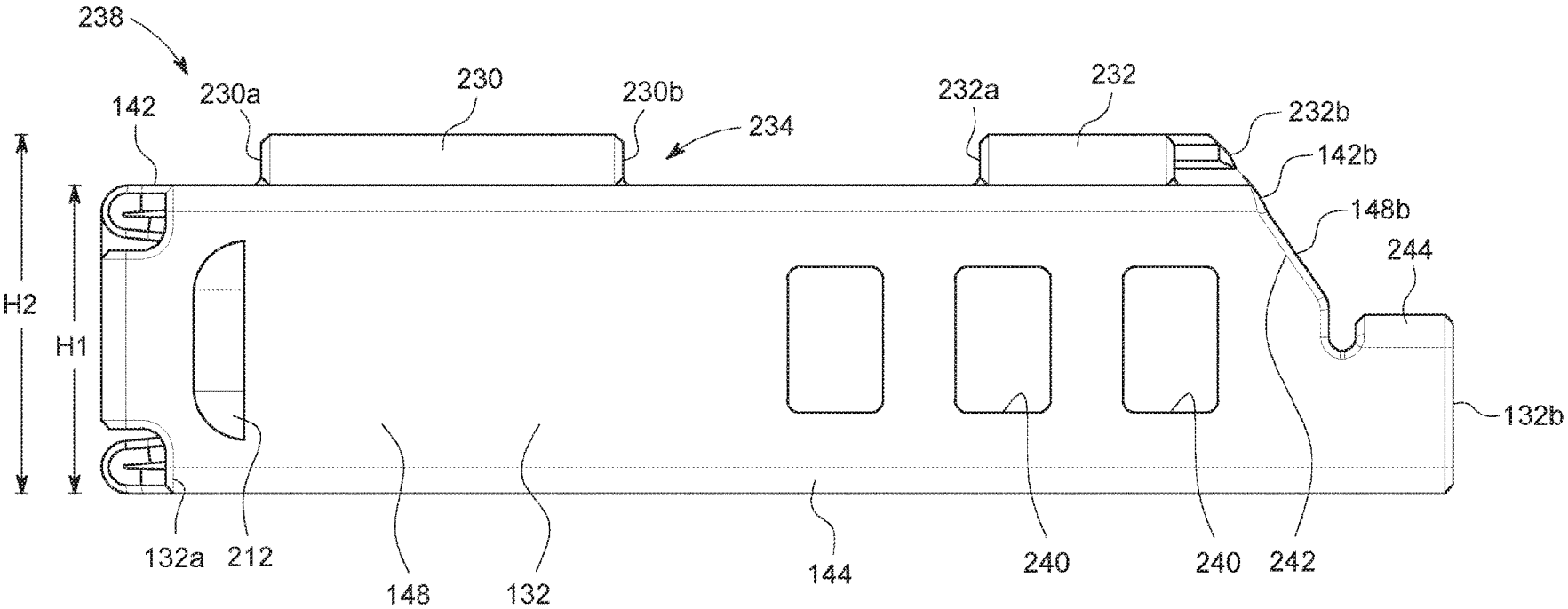
FIG. 15 is a side elevation view of the hood of FIG. 13.
Figure 16:
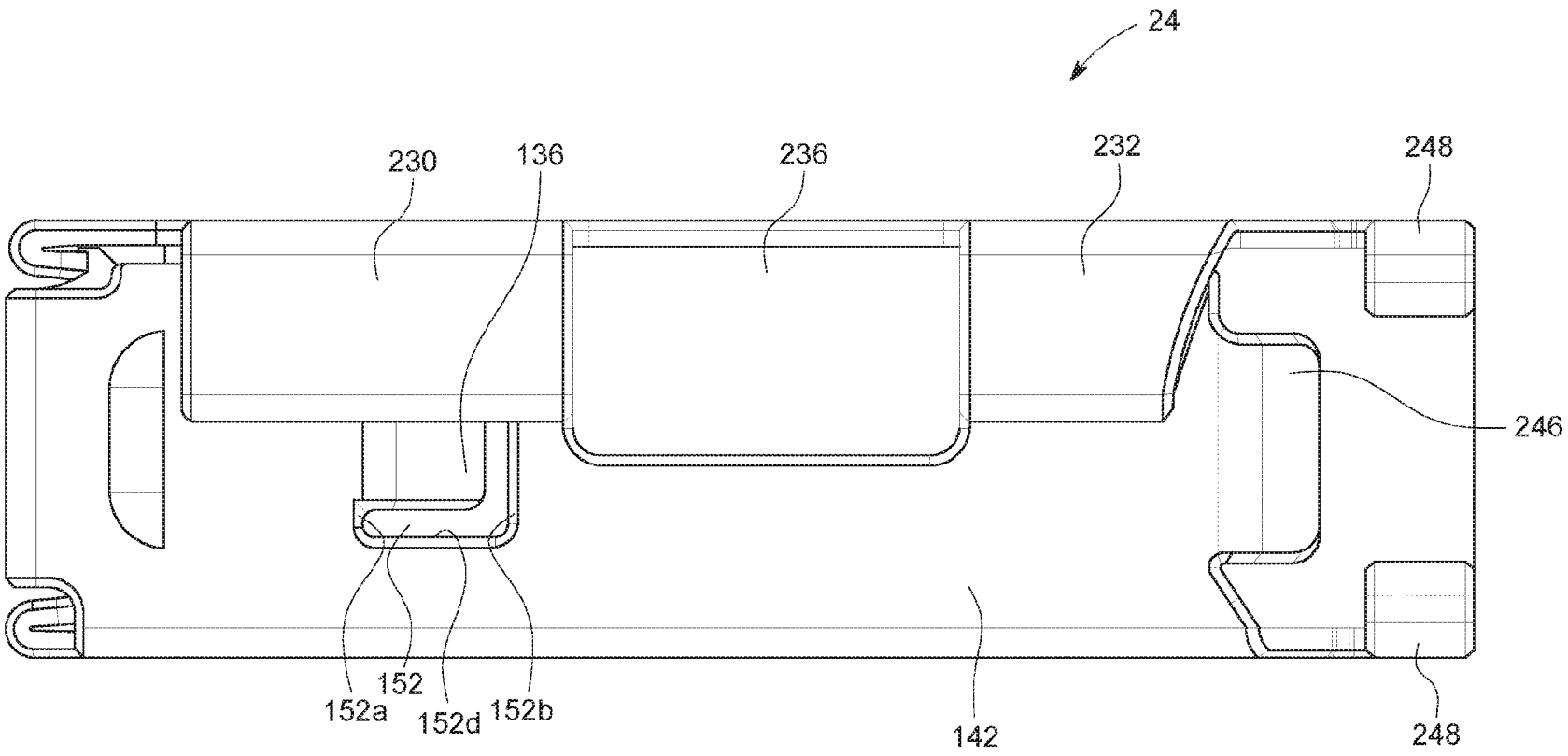
FIG. 16 is a top plan view of the hood of FIG. 13.
Figure 17:
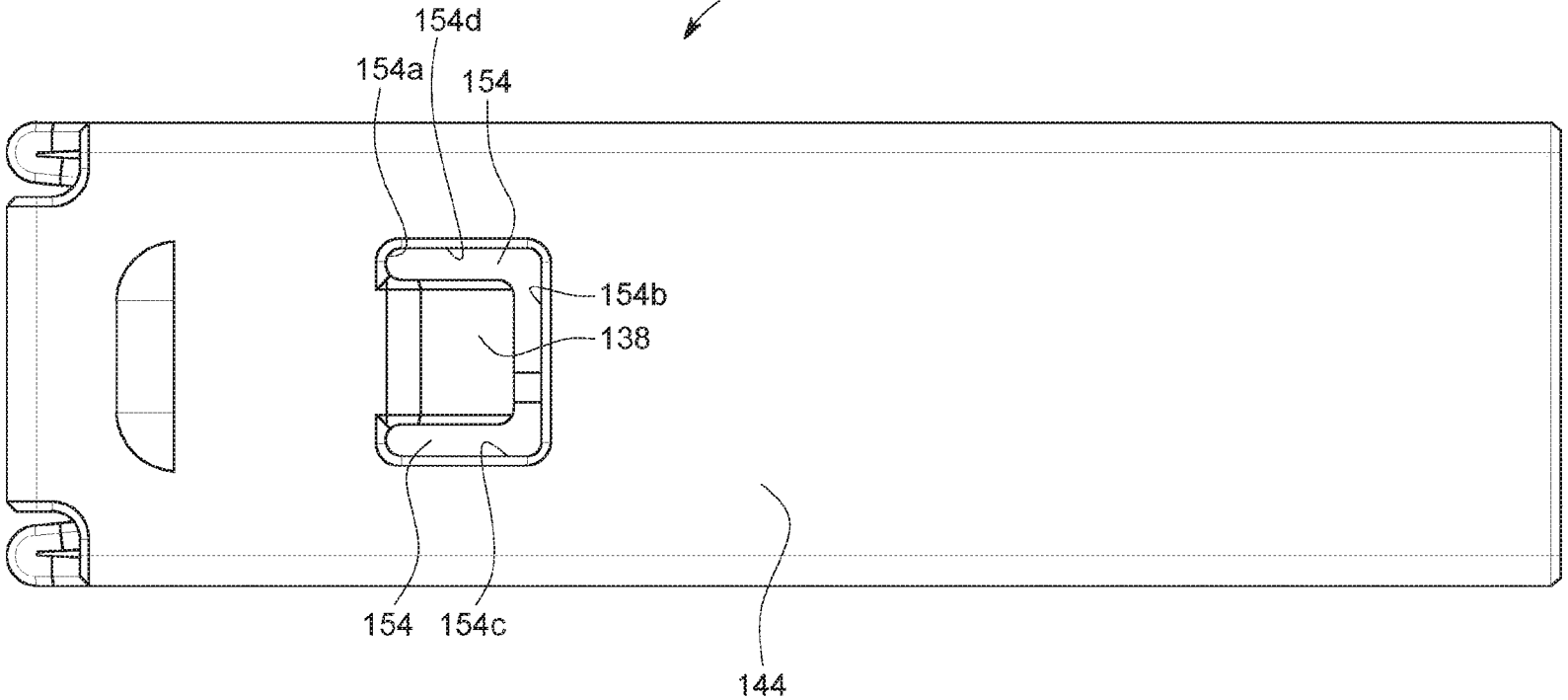
FIG. 17 is a bottom plan view of the hood of FIG. 13.

As shown in FIG. 15, a first height H1 is defined and is measured from the exterior surface of the top wall 142 to the exterior surface of the bottom wall 144. A second height H2 is defined and is measured from the exterior surface of the bottom wall 144 to the planar upper surface 216 of the alignment rib 214, 214'. Height H2 is greater than height H1, but is not substantially greater.

Each side wall 146, 148 has a plurality of spaced apart windows 240 therethrough which are configured to mate with the protrusions 64 on the side walls of the contact 22. The windows 240 are rearward of the stiffening beams 136, 138. In an embodiment, the windows 240 in the side wall 146 are aligned with the windows 240 in the side wall 148.

A rear end 142*b* of the top wall 142 is longitudinally spaced from the rear end 132*b* of the body 132. An upper portion 242 of each rear end 146*b*, 148*b* of the side walls 146, 148 extends at an angle relative to the centerline 140 and extends downwardly and rearwardly from the rear end 142*b* of the top wall 142 toward the rear end 132*b* of the body 132. A lower portion 244 of each rear end 146*b*, 148*b* of the side walls 146, 148 extends parallel to the centerline 140. As such, the angled upper portion 242 is spaced from the rear end 132*b* of the body 132. All edges forming the rear ends 142*b*, 146*b*, 148*b* are chamfered to provide surfaces which angle inwardly toward the passageway 134; the edges may be rounded; the edges are smoothed to remove burrs in the metal. The angled surfaces provided by the rear end 214*b* of the alignment rib 214, 214', the rear end 142*b* of the top wall 142 and the angled upper portion 242 of the rear end 146*b*, 148*b* of the side walls 146, 148 provides a smooth taper and eliminates any sharp corners.

A retaining finger 246 extends from the rear end 142*b* of the top wall 142, at an angle relative to the centerline 140 and into the passageway 134. In an embodiment, the retaining finger 246 has a width which is less than the width of the top wall 142.

In an embodiment, the lower portion 244 of each side wall 146, 148 includes a wall forming a folded over tab 248 which extends into the passageway 132. Each tab 248 includes a U-shaped first wall portion 250 which extends inwardly from the respective side wall 146, 148 and into the passageway, and a second wall portion 252 which extends downwardly from the first wall portion 250. A space 254 is formed by the tab 248.

To assemble the contact 22 with the hood 24, the hood 24 is partially formed, as shown in FIGS. 22-25. In this partially formed condition, the top wall 142 is bent relative to the side wall 148, the stiffening beam 136 is not bent relative to the top wall 142, the stiffening beam 138 is not bent relative to the bottom wall 144, the alignment rib 214 (or alignment rib 214') is partially bent relative to the side wall 146, the side walls 146, 148 are partially bent relative to the bottom wall 144, and the retaining finger 246 and the tabs 248 are only partially bent such that the retaining finger 246 and tabs 248 do not substantially extend into the partially formed passageway 134. The remaining features are formed on the hood 24.

Figure 2:
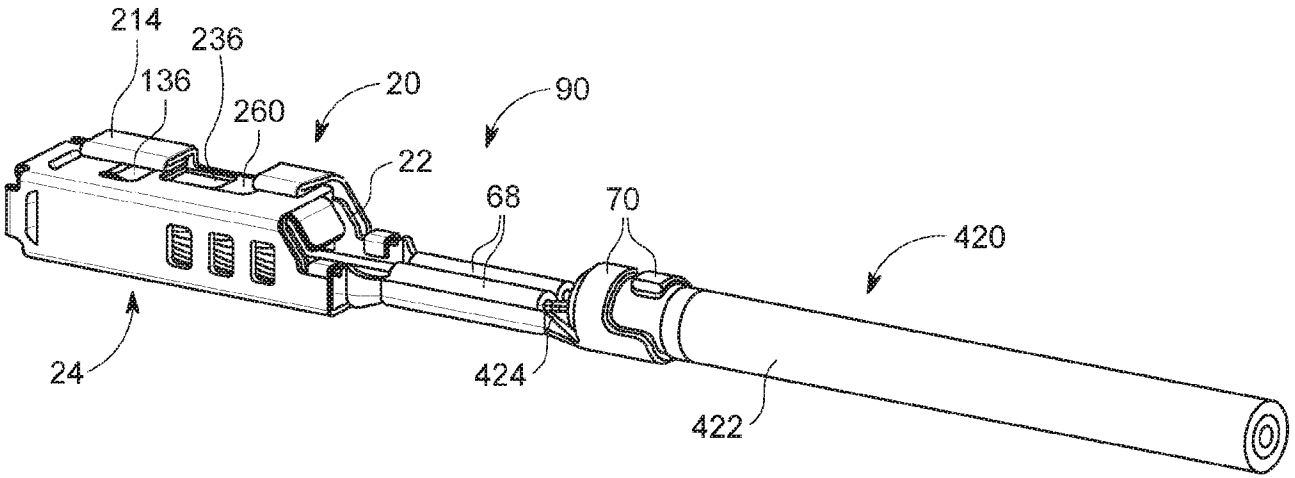
FIG. 2 is a rear perspective view of the connector assembly and contact assembly coupled together.
Figure 3:
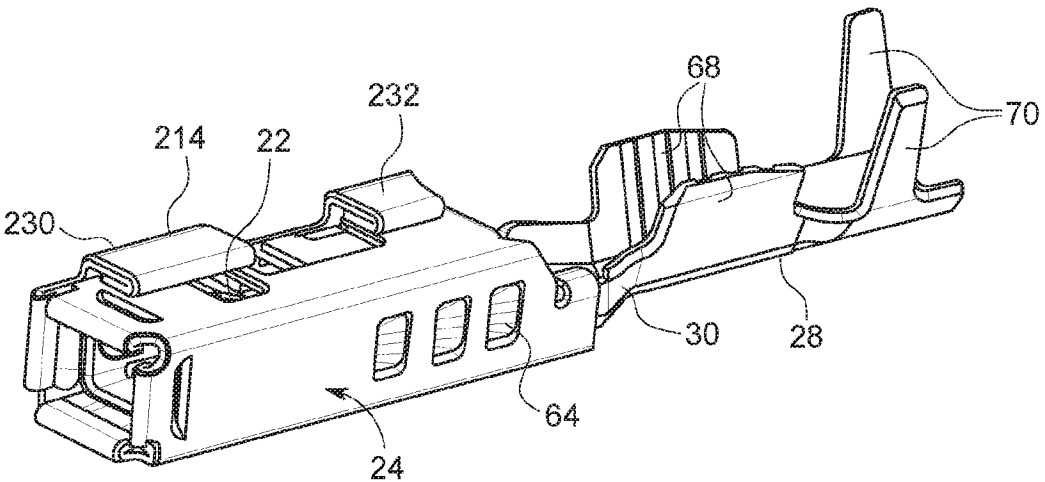
FIG. 3 is a front perspective view of a contact of the contact assembly and a hood of the contact assembly coupled together.
Figure 4:
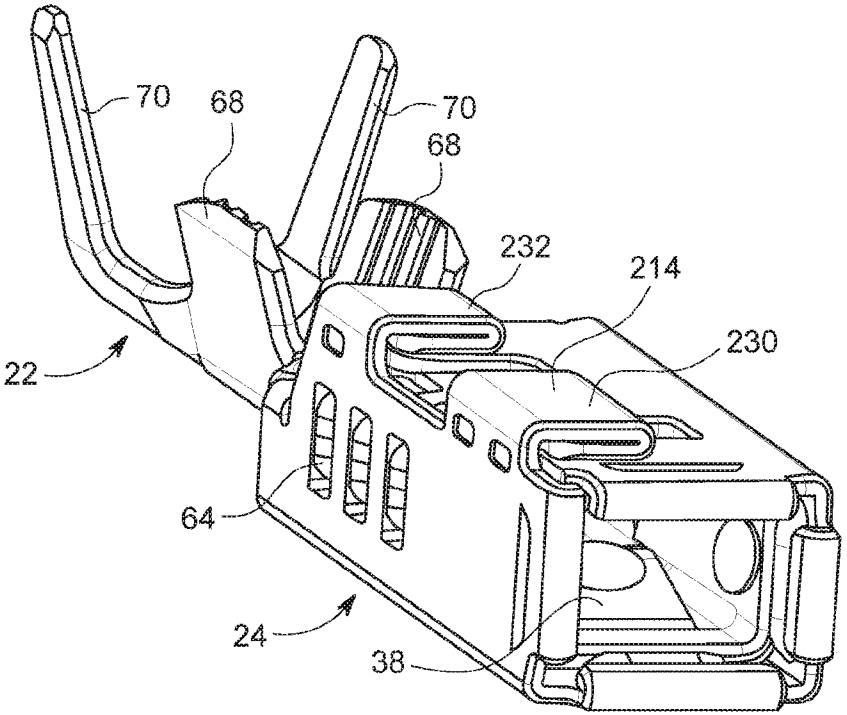
FIG. 4 is a rear perspective view of the contact and the hood coupled together.
Figure 5:
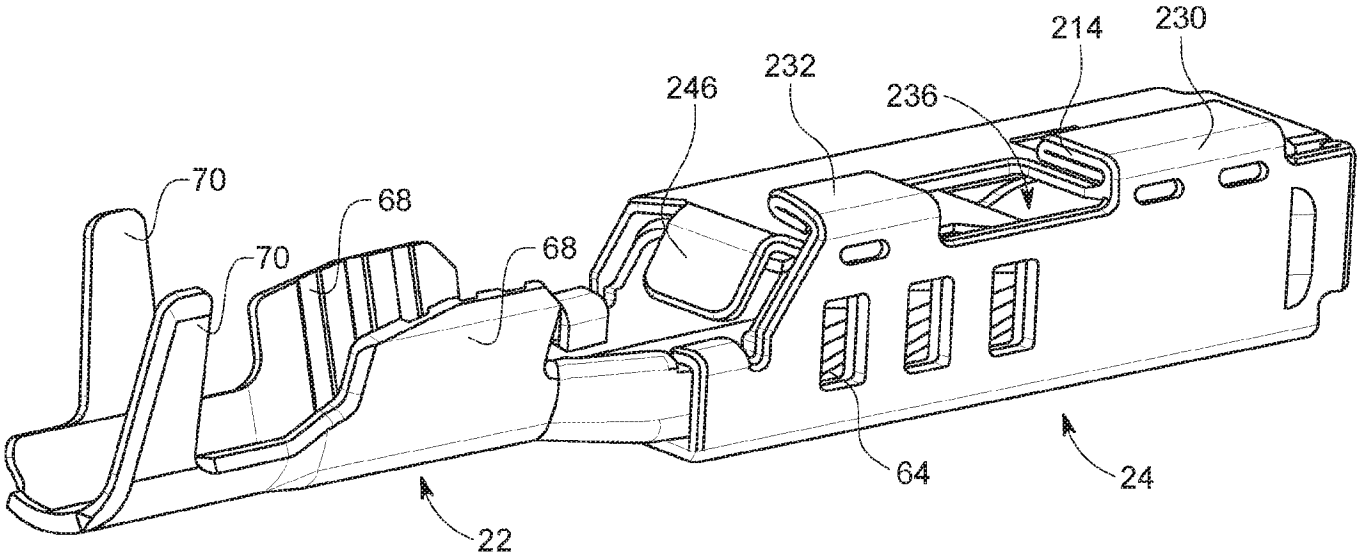
FIG. 5 is an alternate rear perspective view of the contact and the hood coupled together.
Figure 6:
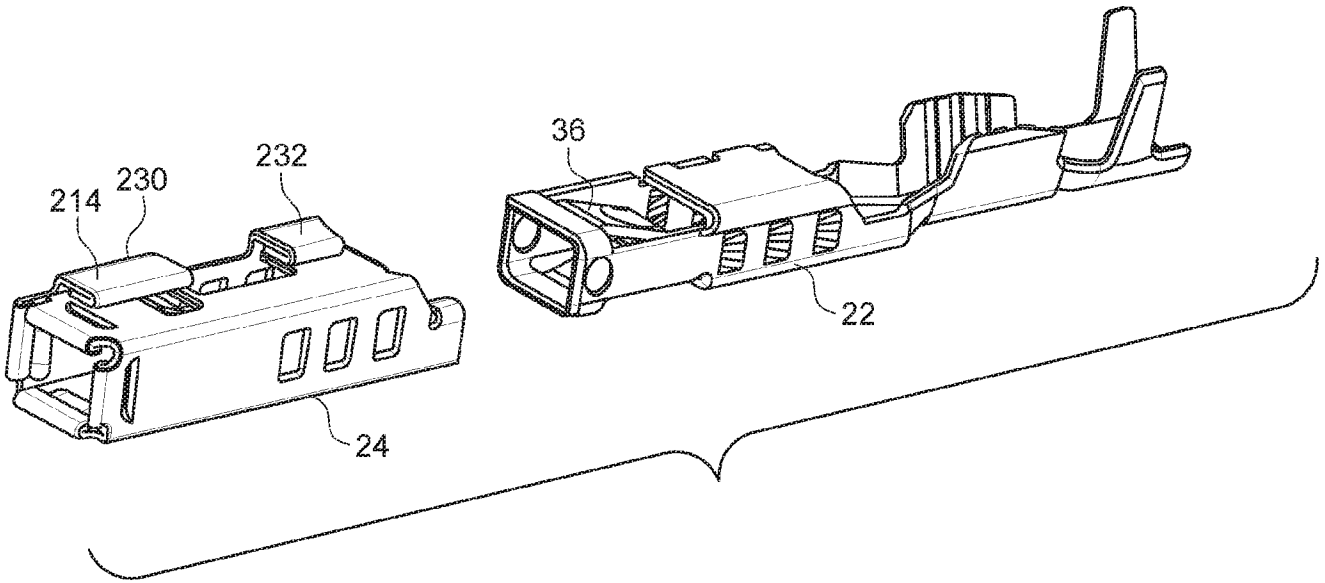
FIG. 6 is a front perspective view of the contact and the hood exploded apart.
Figure 7:
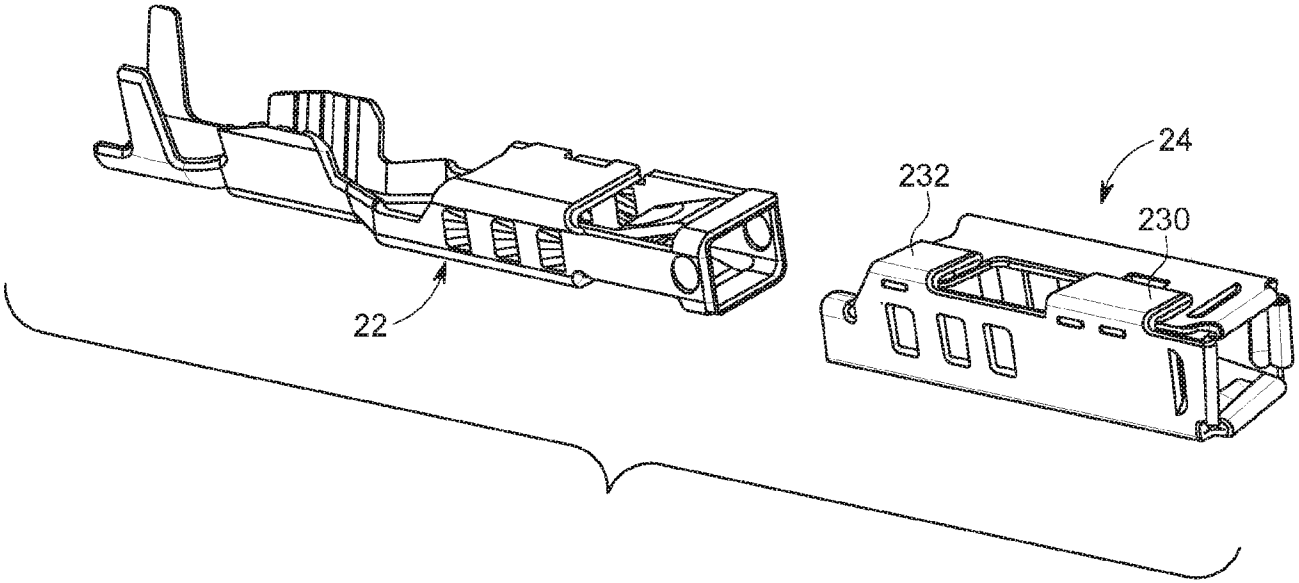
FIG. 7 is a rear perspective view of the contact and the hood exploded apart.
Figure 8:
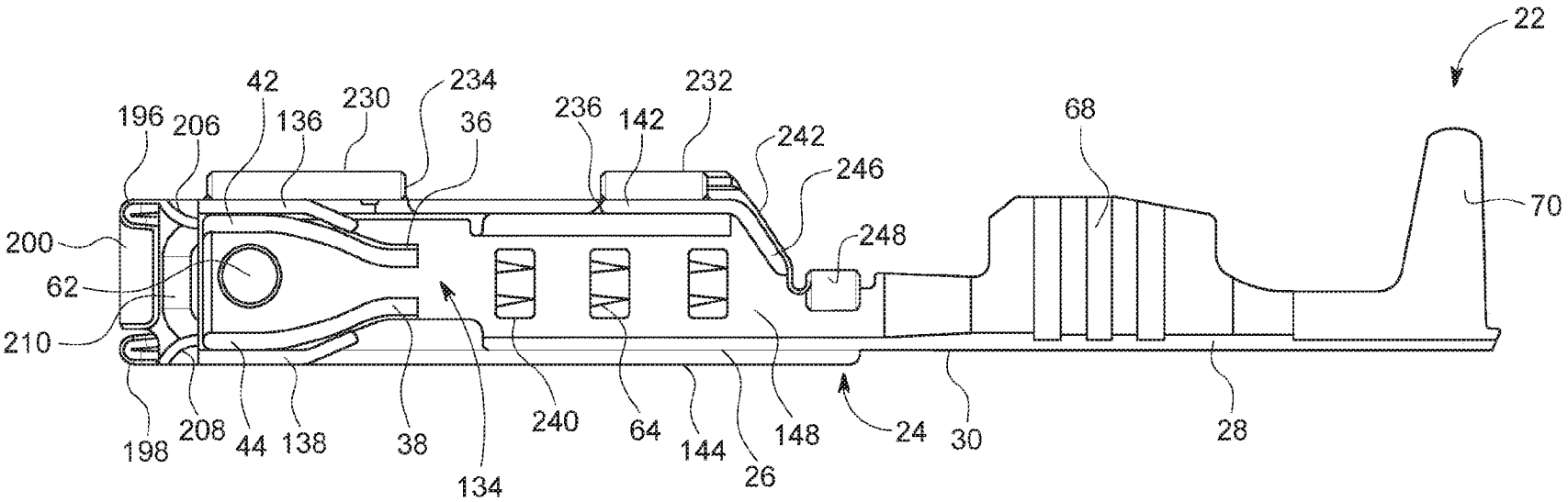
FIG. 8 is a cross-sectional view of the contact and the hood coupled together.
Figure 9:
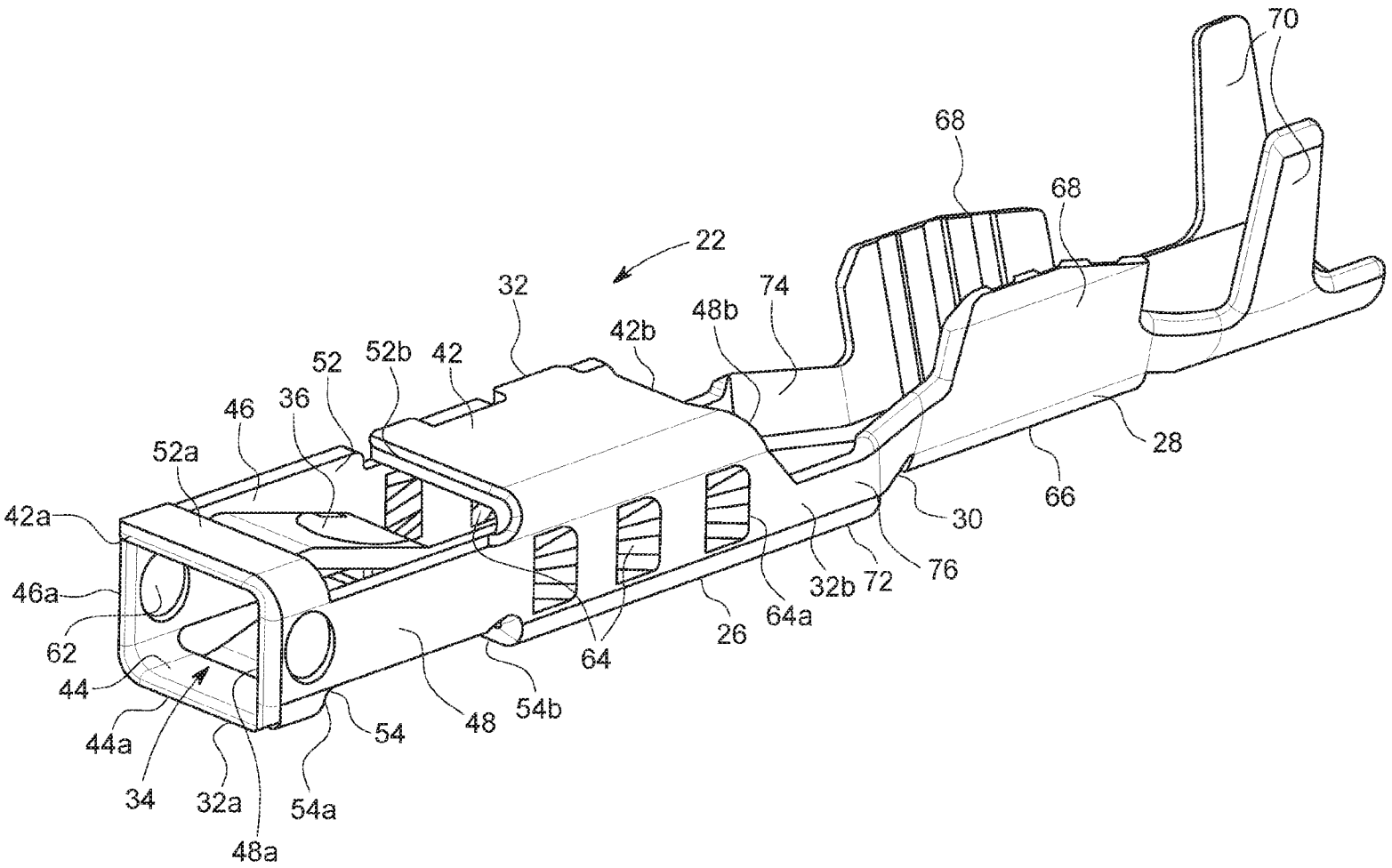
FIG. 9 is a front perspective view of the contact.
Figure 10:
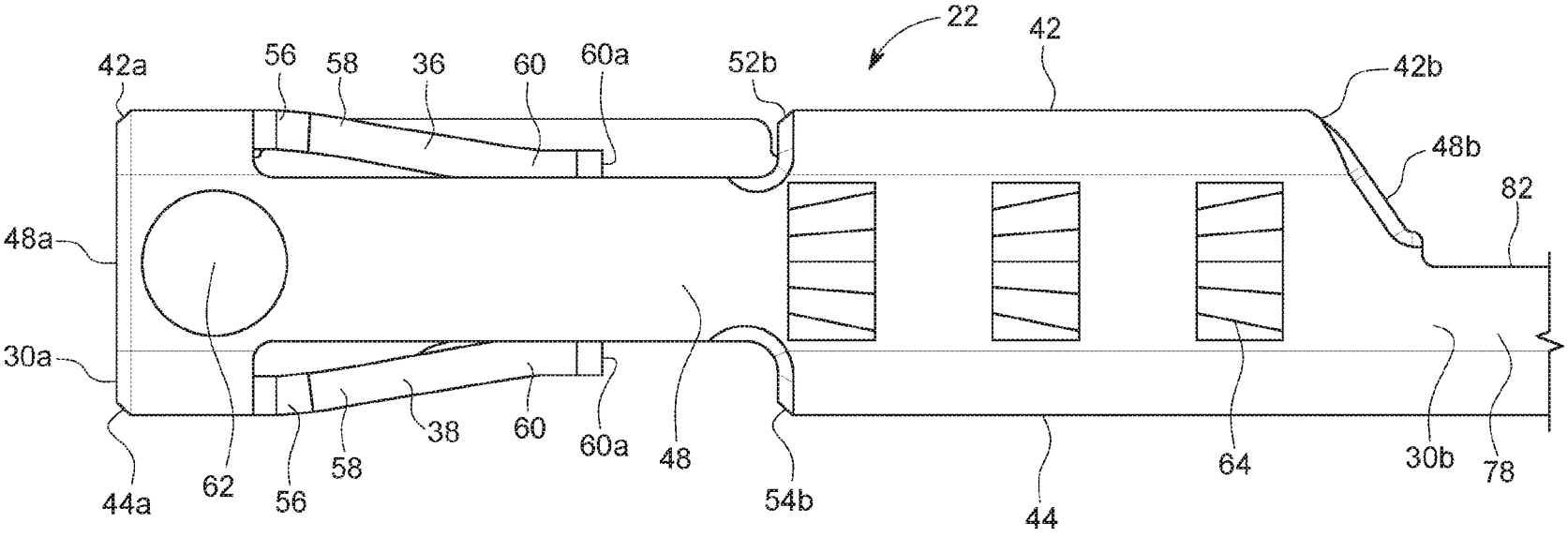
FIG. 10 is a partial side elevation view of the contact.
Figure 11:
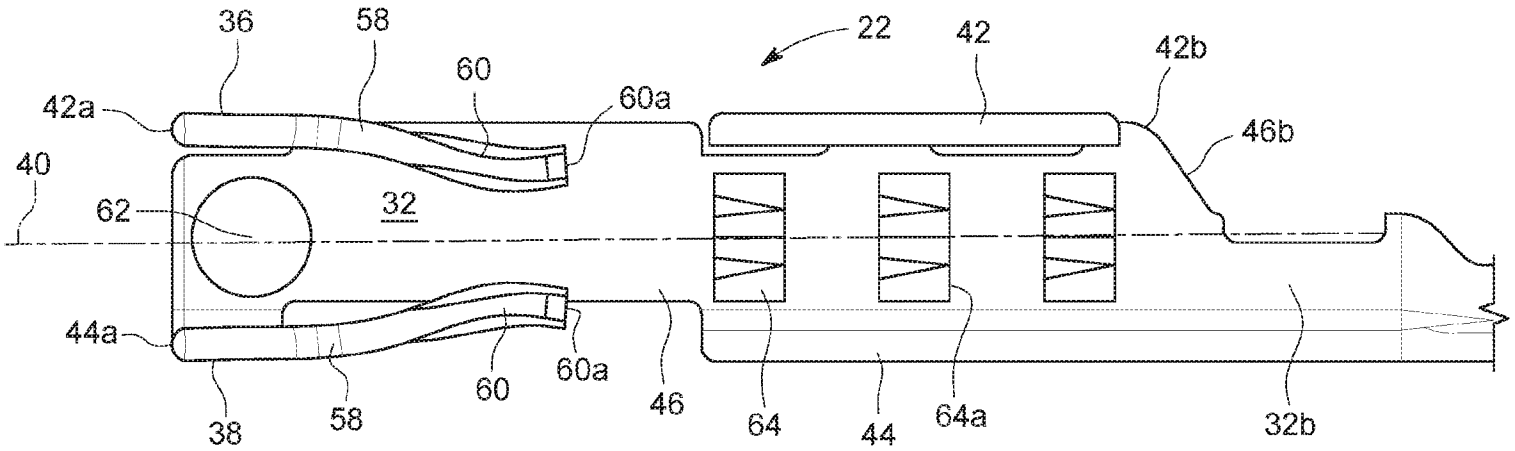
FIG. 11 is a partial cross-sectional view of the contact.
Figure 12:
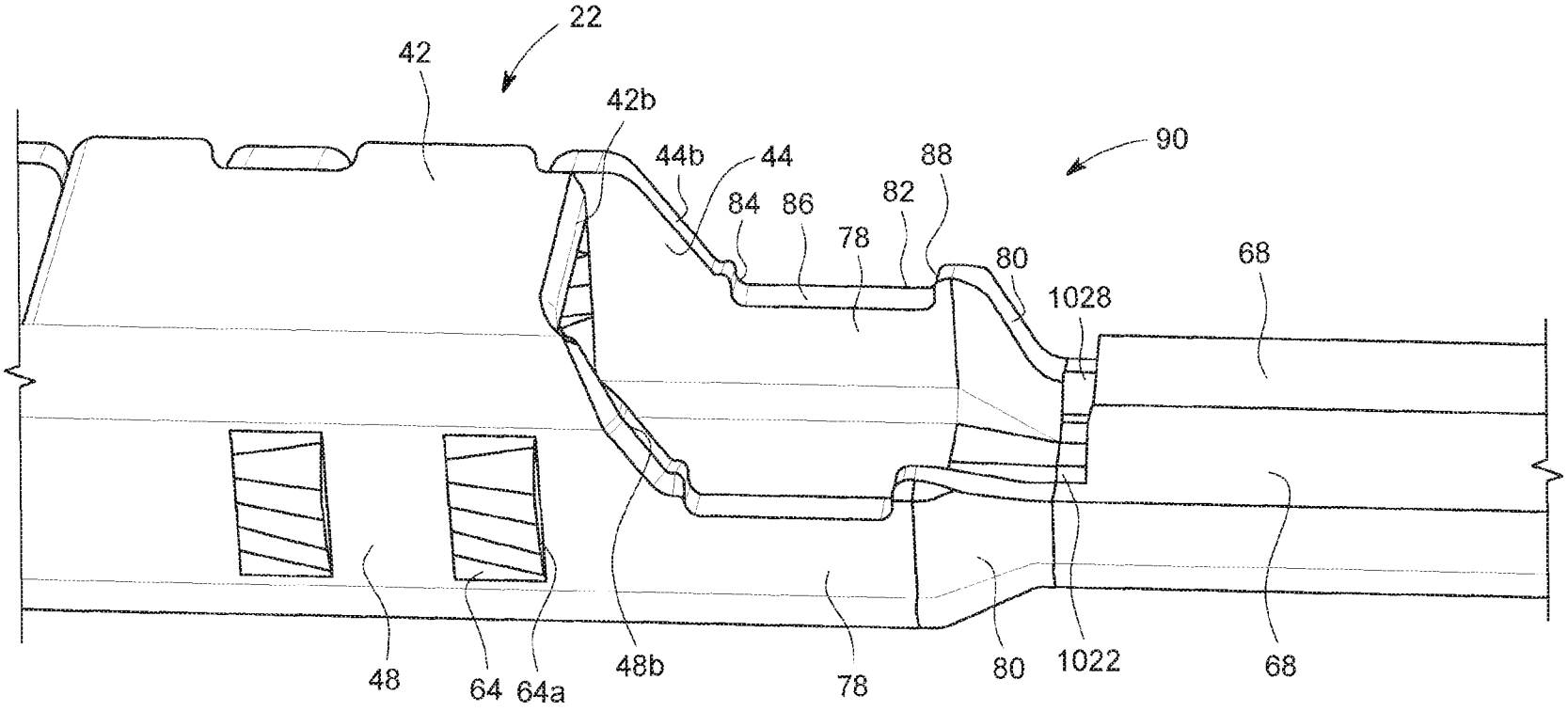
FIG. 12 is a partial rear perspective view of the contact.

The front end of the contact 22 is inserted through the opening formed at the rear end 132*b* of the body 132 of the hood 24 and is slid along the partially formed passageway 134 until the front end 32*a* of the body 32 of the contact 22 engages with the rear faces of the projections 206, 208, 210, 212 on the walls 142, 144, 146, 148. The projections 206, 208, 210, 212 acts as a stop which limits the further insertion of the contact 22 into the hood 24. Thereafter, the side walls 146, 148 are bent relative to the bottom wall 144 to the upright position. During this bending, the top wall 142 engages with side wall 146. The top wall 142 may have tabs 256 which seat within openings 258 in the first wall portion 218 of the alignment rib 214, 214' which secures the top wall 142 to the alignment rib 214, 214'. A portion 260 of the top wall 142, see FIGS. 1 and 2, seats under the window 236 to reduce the size of the window 236. When the walls 146, 148 are bent and the top wall 142 engages with the alignment rib 214, 214', the remaining projections 206, 210, 212 engage the front end 32*a* of the body 32 of the contact 22. In addition, when the walls 146, 148 are bent and the top wall 142 engages with the alignment rib 214, 214', the protrusions 64 seat within the windows 240, but do not extend outwardly from the windows 240 to secure the contact 22 within the hood 24. Thereafter the stiffening beams 136, 138 are bent inwardly to engage the contact beams 36, 136. The alignment rib 214, 214' is then bent relative to the side wall 146 and the top wall 144. If the fifth wall portion 226 is provided, the fifth wall portion 226 seats within the window 228 in the top wall 142 to further secure the alignment rib 214' and the top wall 142 together. The retaining finger 246 is bent. The retaining finger 246 is proximate to the rear end 32*b* of the body 32; therefore, the contact 22 is between the projections 206, 208, 210, 212 and the retaining finger 246. The tabs 248 are folded over and engage with the notches 82 to further secure the contact 22 within the hood 24. As shown in FIG. 8, the innermost surfaces of the projections 206, 208, 210, 212 of the hood 24 are flush with or substantially flush with the interior surfaces of the walls 42, 44, 48, 50. The engagement of the protrusions 64 and the windows 240 and the tabs 248 and notches 82 maintain and lock the contact 22 within the hood 24, thereby preventing separation of the contact 22 and the hood 24. These engagements resist pullout when the contact 22 is acted upon by a withdrawing force.

In an embodiment, all edges which form the various features of the contact 22 and the hood 24 are chamfered to provide surfaces which angle inwardly toward the passageway 34 (even if not specifically described herein). The edges may be rounded. The front edges are smoothed to remove burrs in the metal.

While the protrusions 64 are described as being on the contact 22 and the windows 240 in the hood 24, the protrusions 64 can be provided on the hood 24 and the windows 240 formed in the contact 22. While the fifth wall portion 226 is described as being on the alignment rib 214' and the window 228 in the top wall 142, the fifth wall portion 226 can be provided on the top wall 142 and the window 228 formed in the alignment rib 214'. Either embodiment of the flanges 196, 196', 198, 198', 200, 200', 202, 202' can be used with the fifth wall portion 226 and window 228.

The electrical terminal 20 and its attached lead wire 420 are mounted within the connector assembly 620 as described herein.

As shown in FIGS. 26, 27, 43 and 44, the connector assembly 620 includes a front cover 622, a front housing 624 disposed rearward of the front cover 622, an independent secondary lock 626 disposed rearward of front housing 624, a rear housing 628 disposed rearward of the independent secondary lock 626, a seal 630 disposed rearward of the rear housing 628, and a seal cover or grommet cover 632 disposed rearward of the seal 630.

As shown in FIGS. 28-31, the front cover 622 is formed of a body 638 having a shelf 640 extending therefrom. The body 638 has a front wall 642 having a rear surface 643, opposite top and bottom walls 644, 646 extending rearwardly from the front wall 642, and first and second upright side walls 648, 650 extending rearwardly from the front wall 642 and extending between the top and bottom walls 644, 646. A male terminal receiving passageway 652, a tool receiving passageway 654 and a probe receiving passageway 656 extend through the front wall 642 and through the space 658 formed by the walls 644, 646, 648, 650. The male terminal receiving passageway 652 is sized to receive the male terminal 320 therethrough. The tool receiving passageway 654 is sized to receive a retracting tool 720 therethrough. The probe receiving passageway 656 is sized to receive a probe 820 therethrough. The male terminal receiving passageway 652 is positioned below the tool receiving passageway 654 and the probe receiving passageway 656. The shelf 640 extends rearwardly from the front wall 642 and rearwardly of the body 638 and is received within the front housing 624. The shelf 640 is above the tool receiving passageway 654 and the probe receiving passageway 656.

Figure 32:
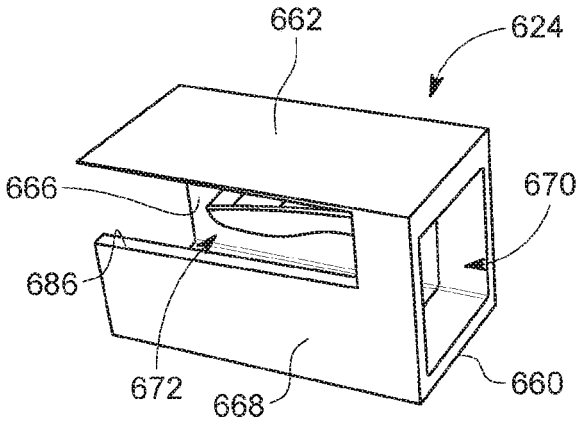
FIG. 32 is a front perspective view of a front housing of the connector assembly.
Figure 33:
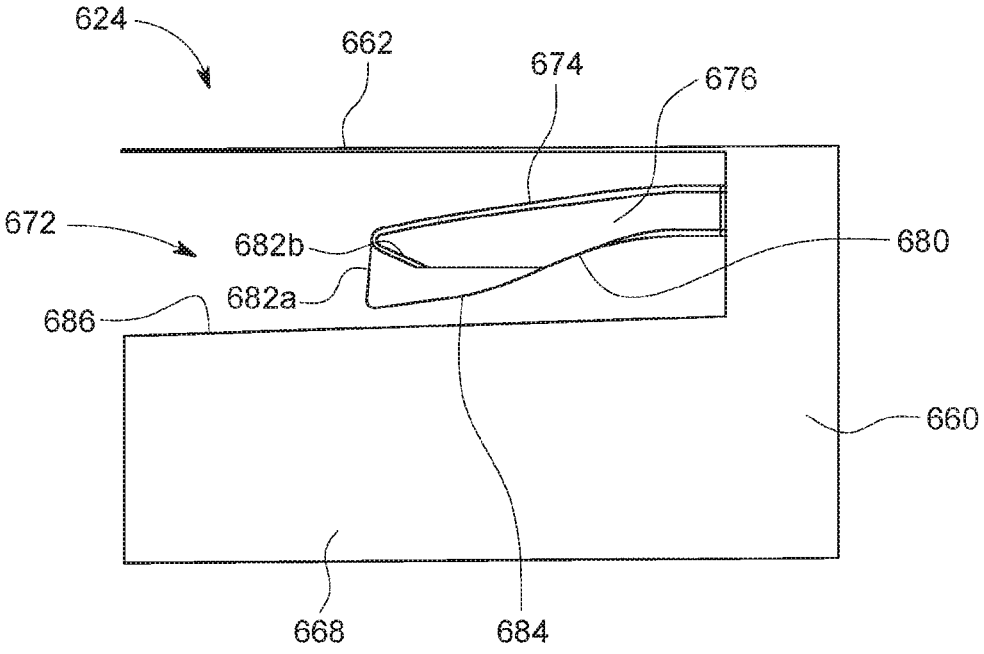
FIG. 33 is a side elevation view of the front housing.
Figure 34:
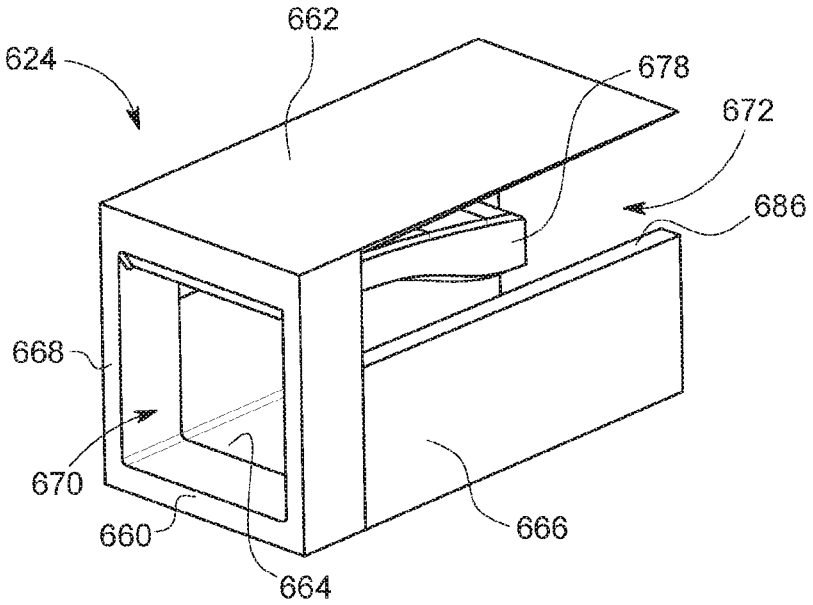
FIG. 34 is a rear perspective view of the front housing.

As shown in FIGS. 32-34, the front housing 624 is formed of a rear wall 660, opposite top and bottom walls 662, 664 extending forwardly from the rear wall 660, and first and second upright side walls 666, 668 extending forwardly from the rear wall 660 and extending between the top and bottom walls 662, 664. A passageway 670 extends through the rear wall 660 and through the space 672 formed by the walls 644, 646, 648, 650. A profiled retention beam or retention finger 674 extends from the top wall 662 downwardly into the space 672. The retention finger 674 has a body portion 676 with an enlarged head 678 at the end of the body portion 676. The body portion 676 has a curved lower surface 680. The head 678 has a front surface portion **682*a* which is substantially vertical, a front surface portion 682*b* which is angled, and a bottom surface 684 which is substantially horizontal. Aligned openings 686 are provided in the side walls 666, 668 which extend from the rear wall 660** forwardly.

The shelf 640 seats within the space 672 and is forward of the front surface portion **682*a* of the retention finger 674**.

Figure 35:
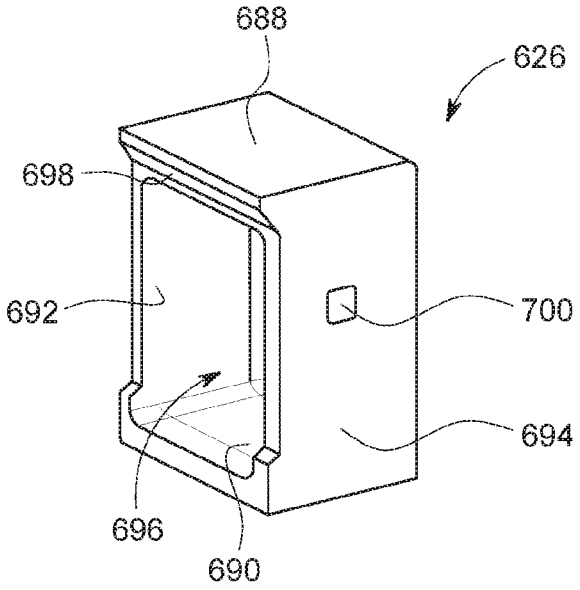
FIG. 35 is a front perspective view of an independent secondary lock of the connector assembly.
Figure 36:
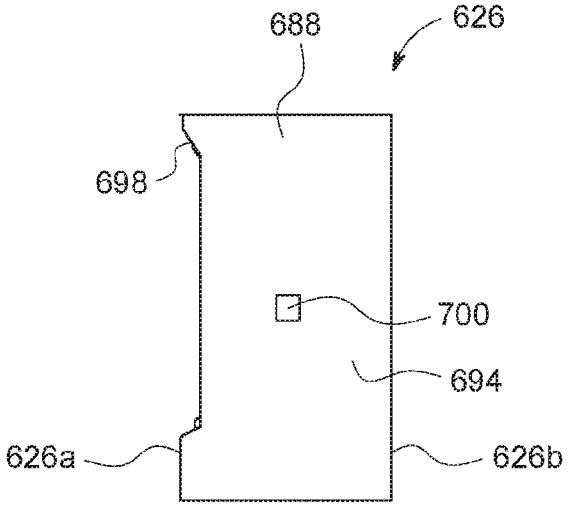
FIG. 36 is a side elevation view of the independent secondary lock.

As shown in FIGS. 35 and 36, the independent secondary lock 626 is formed of opposite top and bottom walls 688, 690 which are separated from each other by side walls 692, 694 and define a central passageway 696 which extends therethrough from a front end **626*a* to a rear end 626*b* of the independent secondary lock 626. The top wall 688 has a front angled face 698. The face 698 extends rearwardly from the front end 626*a*. The face 698 is angled at the same, or substantially the same angle as the angle at which the upper portion 242 of each rear end 146*b*, 148*b* of the side walls 146, 148 of the hood 24 is angled. The independent secondary lock 626 is positioned rearward of the front housing 624. The independent secondary lock 626 can be moved vertically relative to the front housing 624 and can be locked into place relative to the front housing 624 by cooperating locking features 700 (which are only shown on the independent secondary lock 626) provided on the independent secondary lock 626 and on the front housing 624 to place the independent secondary lock 626 into a locked position. Examples of locking features include, but are not limited to, detents, levers, latches. A user can grasp the independent secondary lock 626 through the openings 686 in the front housing 624 to affect movement of the independent secondary lock 626 relative to the front housing 624**.

The rear housing 628 is formed of a body having a passageway therethrough.

Figure 37:
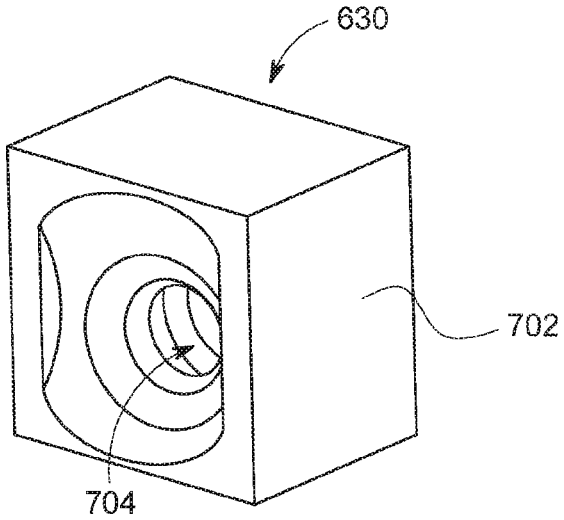
FIG. 37 is a front perspective view of a seal of the connector assembly.
Figure 38:
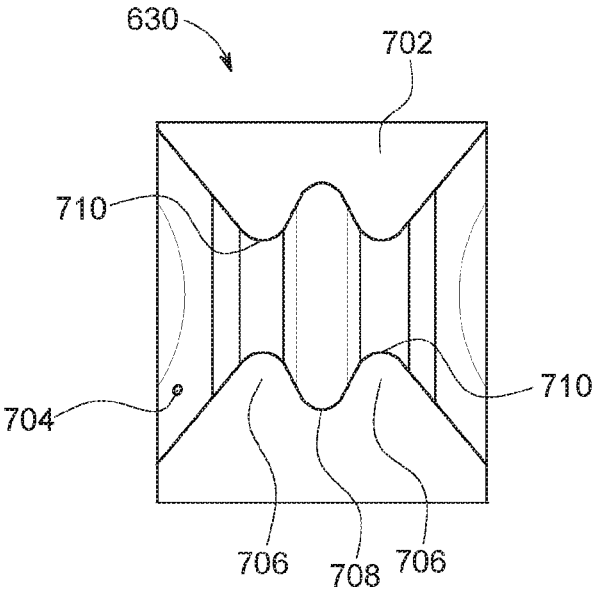
FIG. 38 is a cross-sectional view of the seal.
Figure 39:
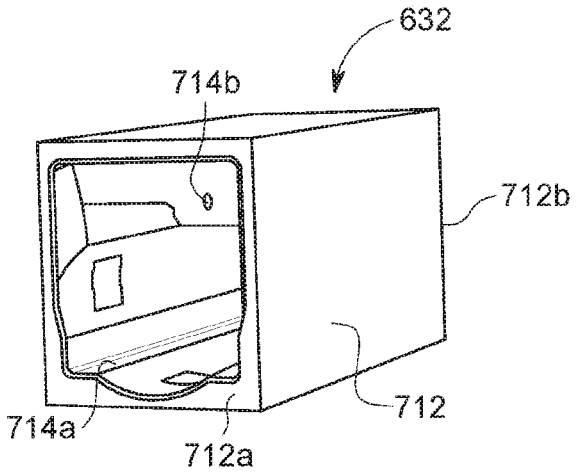
FIG. 39 is a front perspective view of a seal cover or grommet cover of the connector assembly.
Figure 40:
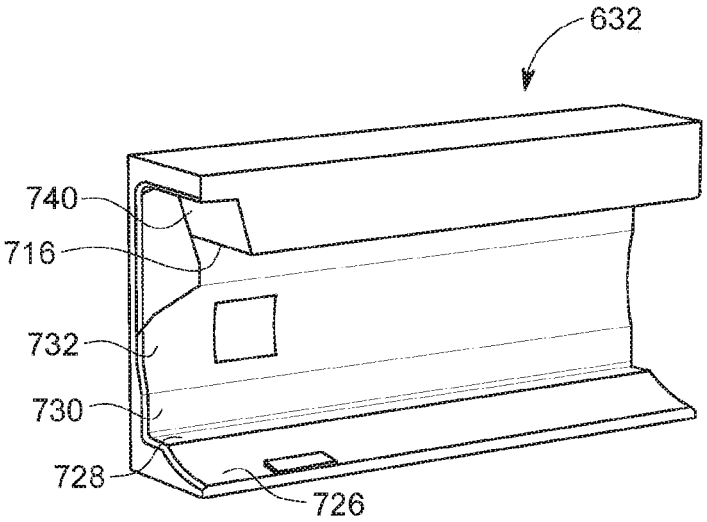
FIG. 40 is a cross-sectional view of the seal cover or grommet cover shown in perspective.
Figure 41:
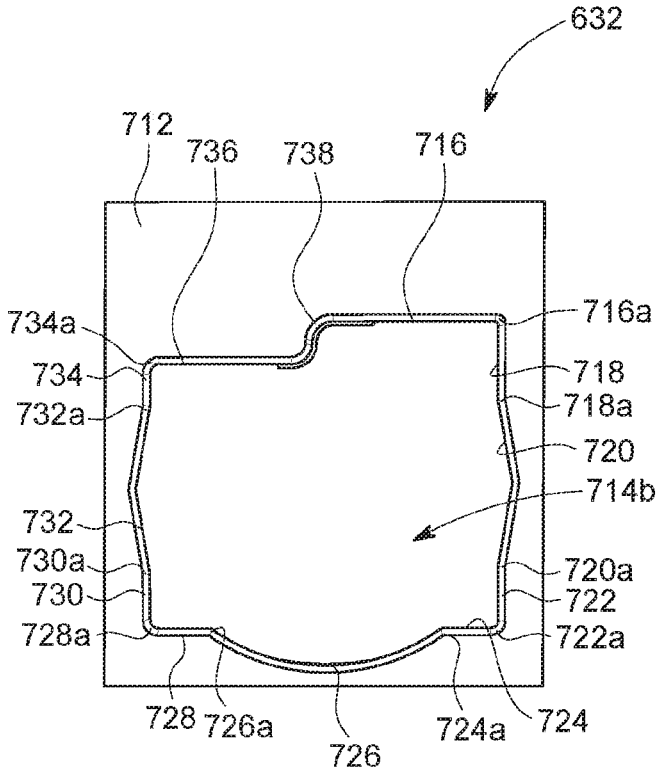
FIG. 41 is a rear elevation view of the seal cover or grommet cover.
Figure 42:
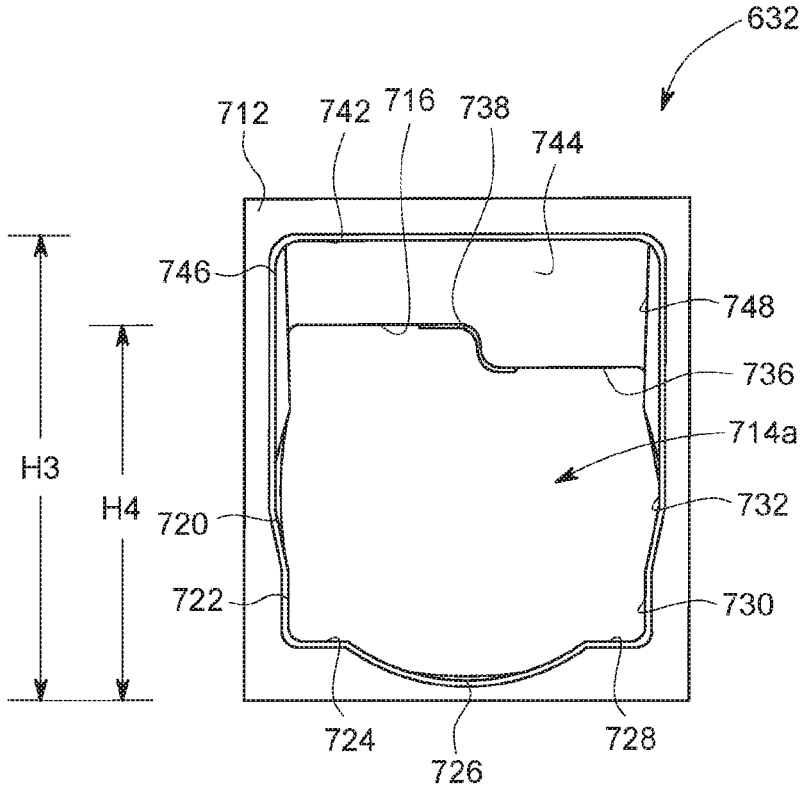
FIG. 42 is a front elevation view of the seal cover or grommet cover.

As shown in FIGS. 37 and 38, the seal 630 is formed of a compliant resilient material, such as rubber, and is configured to engage the insulative covering 422 of the lead wire 420 when the lead wire 420 is inserted therethrough as described herein. The seal 630 is formed of a wall 702 having a central aperture or passageway 704 extending therethrough from a front end **702*a* of the wall 702 to a rear end 702*b* of the wall 702. In an embodiment, the surface forming the passageway 704 is formed as a plurality of compressible lobes, lips or bladders 706 having a lobe 708 therebetween. The bladders 706 define innermost surfaces 710 of reduced dimension of the passageway 704. In an embodiment, the innermost surfaces 710 are circular in shape. The innermost surfaces 710 of the passageway 704 define a dimension which is less than the exterior dimension of the electrical terminal 20, and which is less than the diameter of the insulative covering 422 of the lead wire 4*cl*20. The seal 630 provides a resilient interface with the insulative covering 422 of the lead wire 420** to provide a moisture/debris resistant barrier.

As shown in FIGS. 39-42, the seal cover or grommet cover 632 is formed of a body 712 having a front passageway portion **714*a* extending from a front end 712*a* of the body 712 to a rear passageway portion 714*b* which extends to the rear end 712*b* of the body 712. The front and rear passageway portions 714*a*, 714*b* are sized to allow the electrical terminal 20 to pass therethrough and to allow the insulative covering 422 to pass therethrough without significant resistance. The rear passageway portion 714*b* has a first, upper surface 716 which is horizontal and extends partially across the body 712, a second, side surface 718 extending vertically downwardly from an outer end 716*a* of the upper surface 716, a third, side surface 720 extending vertically downwardly from a lower end 718***a* of the side surface 718, the side surface 720 being curved, a fourth, side surface 722 extending vertically downwardly from a lower end 720*a* of the side surface 720, a fifth, lower surface 724 extending horizontally from a lower end 722*a* of the side surface 722, the fifth surface 724 being parallel to, and underneath, the upper surface 716, a sixth, lower surface 726 extending from the end 724*a* of the lower surface 724, the side surface 726 being curved, a seventh lower surface 728 extending horizontally from the end 726*a* of the lower surface 726, the seventh surface 728 being aligned with the lower surface 724, an eighth, side surface 730 extending vertically upwardly from an end 728*a* of the lower surface 728 and being parallel to and aligned with the side surface 722, a ninth, side surface 732 extending from the end 730*a* of the side surface 730, the side surface 732 being curved, a tenth, side surface 734 extending vertically upwardly from the end 732*a* of the side surface 732, the side surface 734 being aligned with the side surface 730 and with the side surface 718, an eleventh, upper surface 736 extending horizontally from the upper end 734*a* of the side surface 734 and toward the upper surface 716, the upper surface 734 being parallel to, but vertically offset below, the upper surface 716, a twelfth upper surface 738 which is generally formed as an "S" or "Z" shape, which connects the upper surfaces 716, 736 together. The surfaces 720, 726, 732 fall along an imaginary circle. The surfaces 718, 722, 724, 728, 730, 734, 736 correspond to the shape of the body 132 of the hood 24, and the body 132 of the hood 24 passes through these surfaces 718, 722, 724, 728, 730, 734, 736 during insertion of the contact assembly 90 therethrough. The surfaces 716, 718, 738 form a keyway of the passageway 720 and correspond to the shape of the alignment rib 214, 214' and the alignment rib 214, 214' of the hood 24 passes through these surfaces 716, 718, 738 during insertion of the contact assembly 90 therethrough. The insulative covering 422 passes through these surfaces 720, 726, 732 during insertion of the contact assembly 90 therethrough. The surfaces 720, 722, 724, 726, 728, 730 extend from the front end 712*a* of the body 712 to the rear end 712*b* of the body 712 such that these surfaces 720, 722, 724, 726, 728, 730 also extend through the front passageway portion 714*a*. The front ends of the surfaces 716, 736, 738 are spaced from the front end 712*a* of the body 712 such that a front recess 740 is formed in the body 712 which forms an upper portion of the front passageway portion 714*a*. The front recess 740 is formed from an upper wall 742 which extends from the front end 712*a* of the body 712 to a rear wall 744 extending upwardly from the front end of the surfaces 716, 736, 738, and side walls 746, 748 which extend from the front end 712*a* of the body 712 to the rear wall 744. The front recess 740 causes the front passageway portion 714*a* to have a height H3 (the distance between the surface 726 and the surface 742) which is greater than a height H4 (the distance between the surface 726 and the surface 716) of the rear passageway portion 714*b*.

To assemble the contact assembly 90 with the connector assembly 620, the electrical terminal 20 is inserted into and through the seal cover or grommet cover 632. The electrical terminal 20 can only be inserted in one way into the seal cover or grommet cover 632 since the alignment rib 214, 214' must seat within the keyway formed by the surfaces 716, 718, 738. This seating of the alignment rib 214, 214' within the keyway properly aligns the electrical terminal and prevents the electrical terminal 20 from rotating within the seal cover or grommet cover 632.

Figure 43:
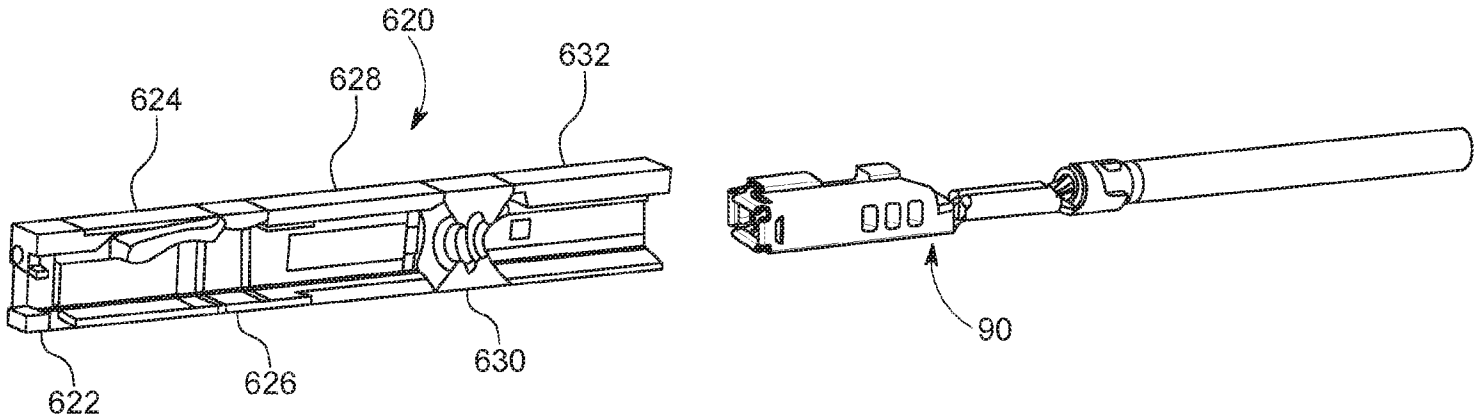
FIG. 43 is a cross-sectional view of the connector assembly with the lock in an unlocked position and shown in front perspective, and the contact assembly exploded therefrom and shown in front perspective.
Figure 44:
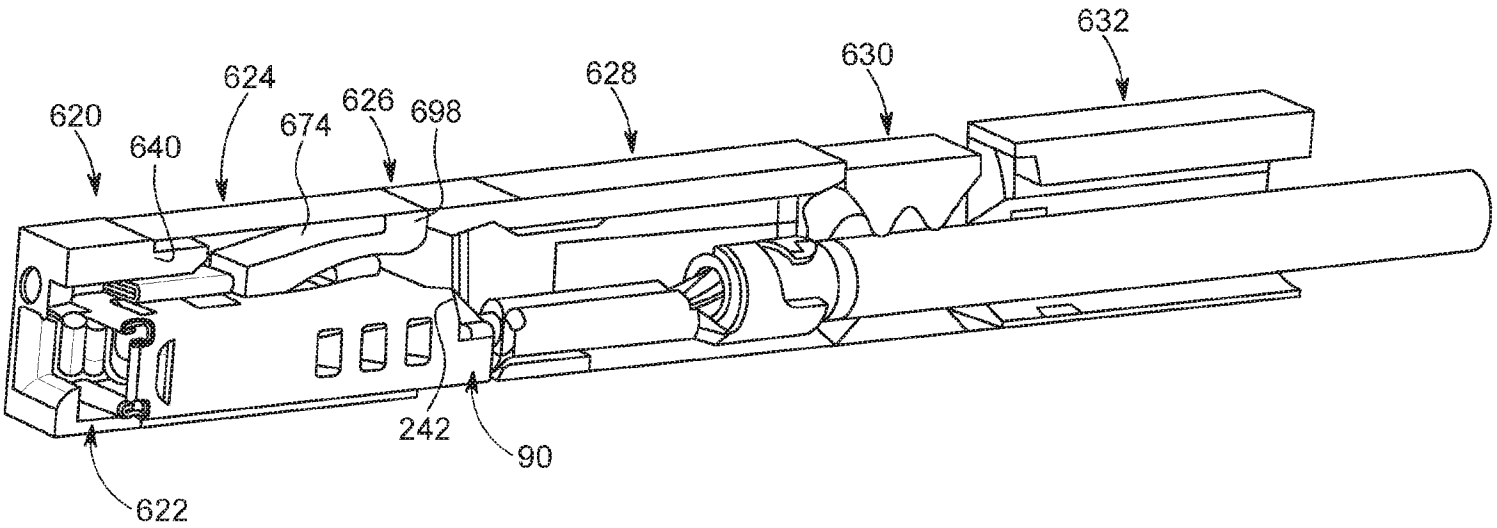
FIG. 44 is a cross-sectional view of the connector assembly with the lock in the unlocked position and shown in front perspective, and a front perspective view of the contact assembly, the connector assembly and the contact assembly being shown in an assembled condition.

Thereafter, the electrical terminal 20 is passed through the passageway 704 of the seal 630. As the electrical terminal 20 passes through seal 630, the front end 132*a* of the body 132 first engages with the innermost surfaces 710 and expands the seal 630 outwardly. The flanges 196, 196', 198, 198', 200, 200', 202, 202' assist in reducing any tear risk of the seal 630 upon contact with the hood 24. The bladders 706 of the seal 630 compress to conform to the exterior shape of the hood 24. As the contact assembly 90 continues to be passed through, the front end 214*a* of the alignment rib 214, 214' next contacts the bladders 706 of the seal 630. The height H2 o the combined body 132 and alignment rib 214, 214' is greater than the height H1 of the body 132 alone, however, the height difference is small. Therefore, when the seal 302 further expands to accommodate the increased height H2 over height H1, the seal 602 is not significantly further expanded and therefore the risk of any tearing of the seal 602 is minimal. As the contact assembly 90 passes through the seal 602, when the insulative covering 422 is within the seal 630, the seal 630 contracts and the bladders 706 engage and seal with the insulative covering 422. The electrical terminal 20 then passes into and through the passageway in the rear housing 628 and then into and through the passageway 696 in the independent seal lock 626. The independent seal lock 626 is in an unlocked position as shown in FIG. 43 which allows the contact assembly 90 to freely pass therethrough. The electrical terminal 20 then passes into the passageway 670 of the front housing 624 until the retention finger 674 on the front housing 624 seats within the window 236 in the electrical terminal 20 and the front ends of the flanges 196, 196', 198, 198', 200, 200', 202, 202' of the contact assembly 90 engage against the rear face 643 of the front cover 622. During this, the bottom surface 684 of the head 678 of the retention finger 674 first engages the top wall 142 of the hood 24 and deflects. Thereafter, the curved lower surface 680 engages the front end 214*a* of the alignment rib 214, 214' and the retention finger 674 further deflects and continues to deflect until the bottom surface 684 of the head 678 engages the planar top surface 216 of the alignment rib 214, 214'. After the front section 230 of the alignment rib 214, 214' slides past the head 678, the retention finger 674 resumes its original shape and the head 678 seats within the window 236 in the hood 24. The area above the portion 260 of the top wall 142 provides a space for the curved lower surface 680 to seat. The front surface portion 682*a* of the head 678 engages against the front edge 236*a* of the window 236 and the front surface portion 682*b* is above the top wall 142 of the hood 24 such that a space 750 is formed between the front surface portion 682*b* and the top wall 142. This engagement of the retention finger 674 within the window 236 and the engagement of the front ends of the flanges 196, 196', 198, 198', 200, 200', 202, 202' of the contact assembly 90 with the rear face 643 of the front cover 622 prevents the further insertion of the electrical terminal 20 into the contact assembly 90 and also prevents the removal of the electrical terminal 20 from the contact assembly 90. The shelf 640 is between the interior surface of the top wall 662 of the front housing 624 and the planar top surface 216 of the alignment rib 214, 214' to prevent the electrical terminal 20 from tipping within the connector assembly 1020.

Figure 45:
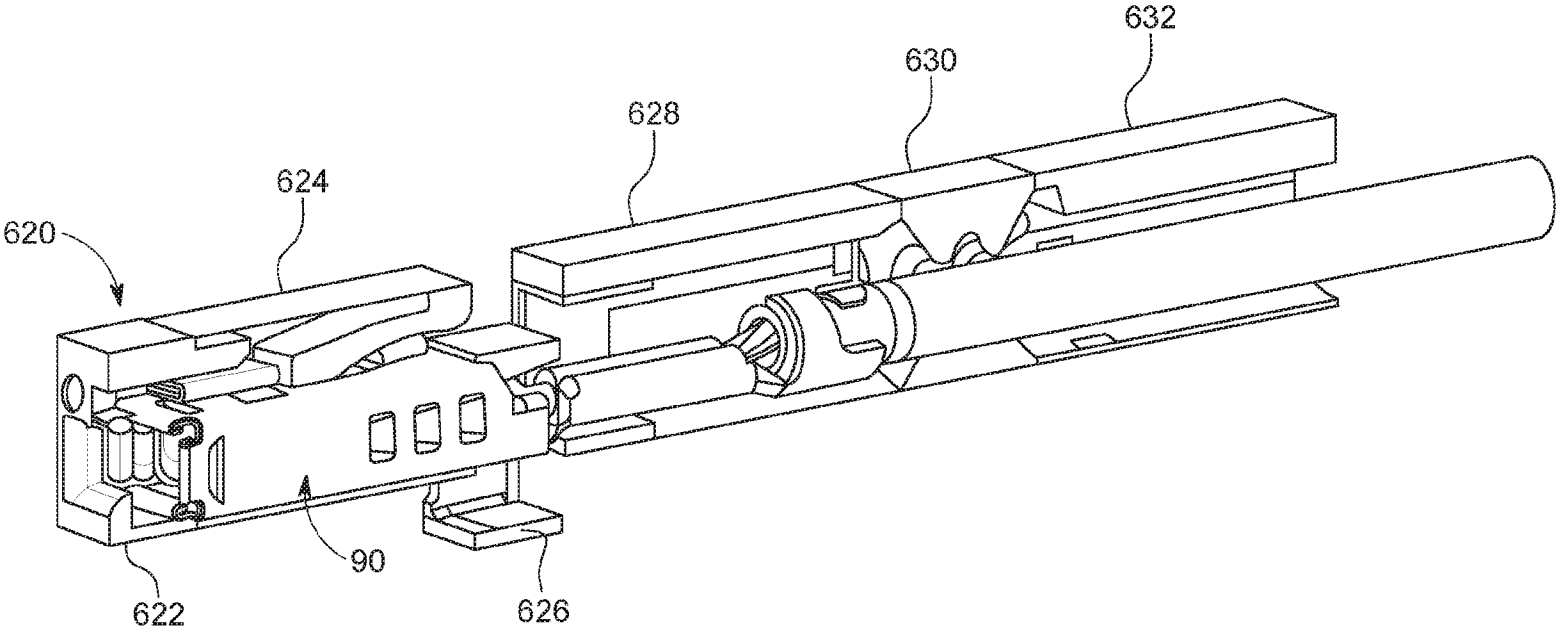
FIG. 45 is a cross-sectional view of the connector assembly with the lock in the locked position and shown in front perspective, and a front perspective view of the contact assembly, the connector assembly and the contact assembly being shown in an assembled condition.
Figure 46:
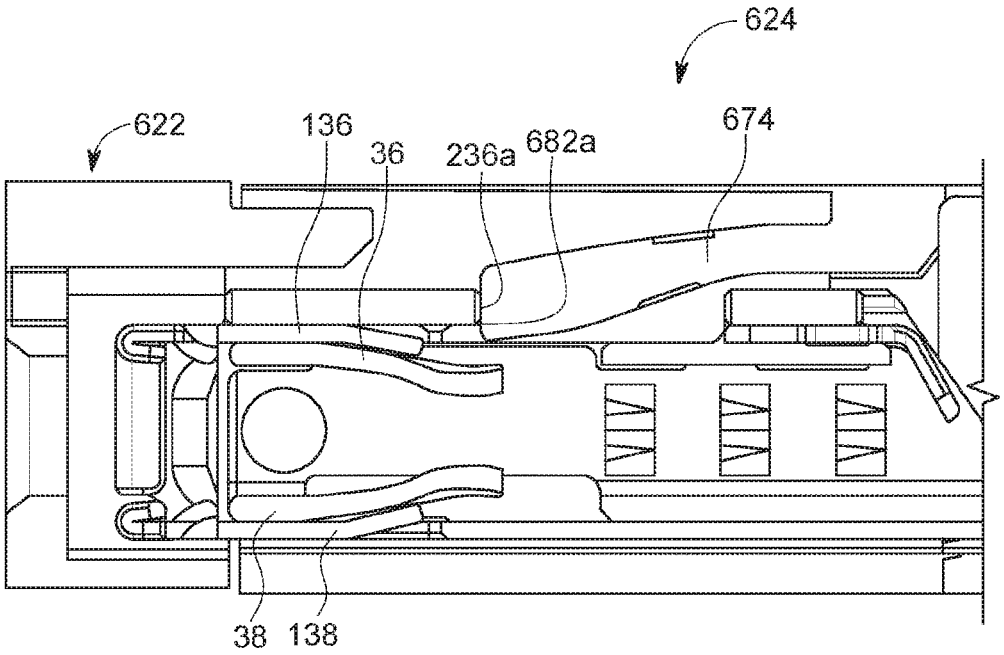
FIG. 46 is a partial cross-sectional view of the connector assembly and contact assembly in an assembled condition.
Figure 47:
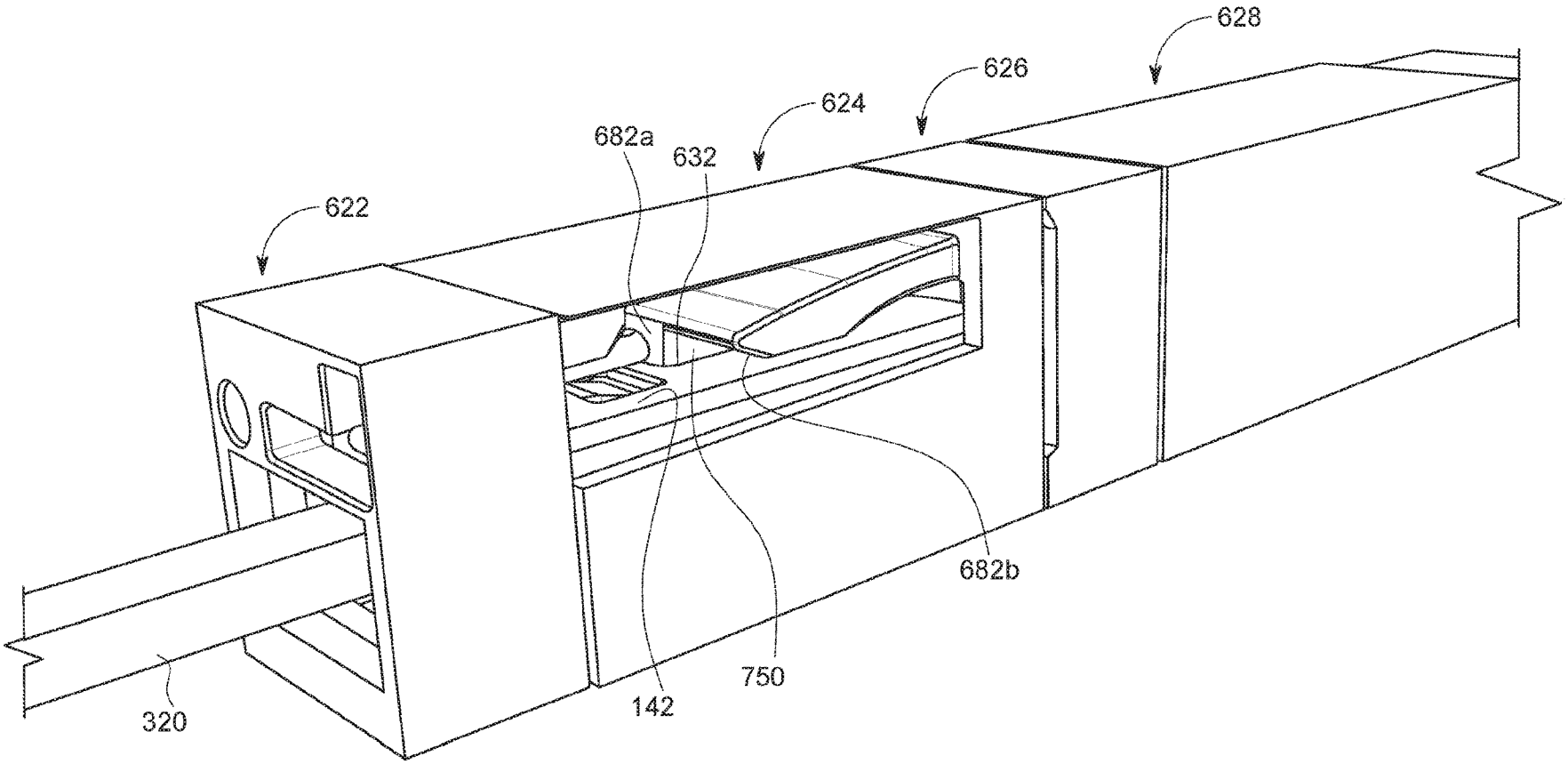
FIG. 47 is a partial front perspective view of the connector assembly, contact assembly and male terminal in an assembled condition.
Figure 48:
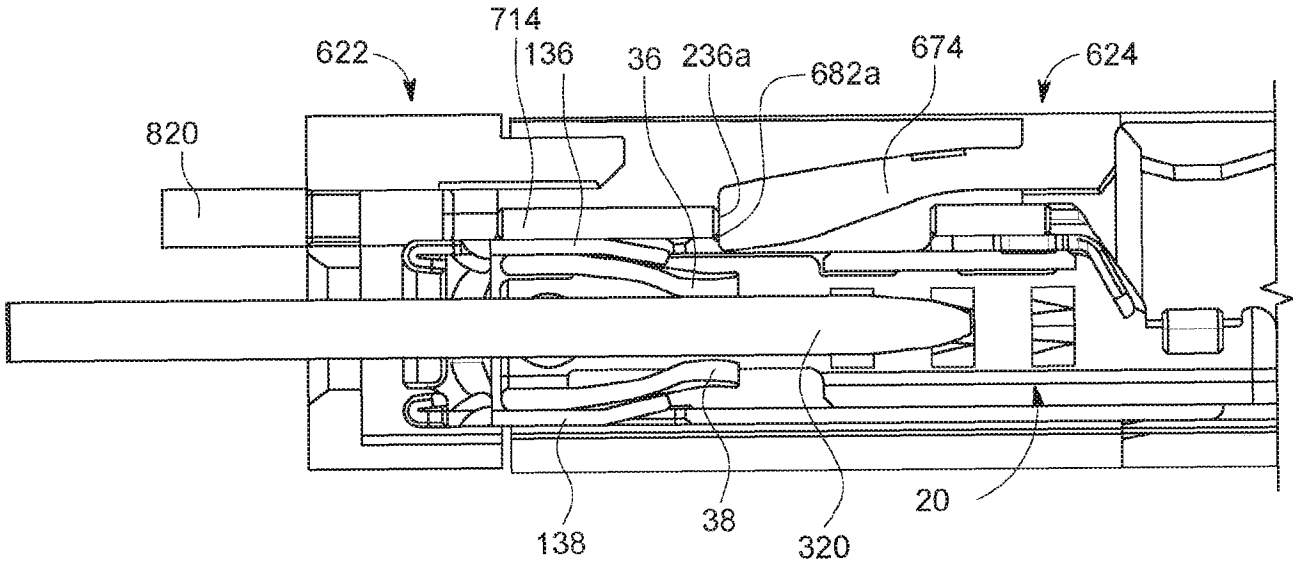
FIG. 48 is a partial cross-sectional view of the connector assembly and contact assembly in an assembled condition, and with the male terminal and a probe inserted therein.

When the contact assembly 90 is in the unlocked position within the connector assembly 1020, the insulative covering 422 of the lead wire 420 is engaged with the bladders 706 of the seal 602. After the contact assembly 90 is inserted, the independent secondary lock 626 is moved transversely relative to the centerline 140 of the hood 24 until the angled wall 698 on the independent secondary lock 626 engages against the angled upper portion 242 of each rear end 146*b*, 148*b* of the side walls 146, 148 of the hood 24. The independent secondary lock 626 is secured in place by the mating locking feature 700 into the locked position as shown in FIG. 45. The independent secondary lock 626 prevents any rearward movement of the electrical terminal 20 and thus prevents the withdrawal of the contact assembly 90 from the connector assembly 620.

The male terminal 320 is then mounted within the connector assembly 620 and the contact assembly 90. The male terminal 320 is inserted into and through the male terminal receiving passageway 652 and the space 658 in the front cover 622. Thereafter, the male terminal 320 passes through the entrance opening 204 of the electrical terminal 20 and the male terminal 320 may engage the flanges 196, 196', 198, 198', 200, 200', 202, 202' on the hood 24 which guide the male terminal 320 into the passageway 134 of the hood 132. As the male terminal 320 is slid further into the hood 24, the male terminal 320 engages the projections 206, 208, 210, 212 which provide a lead in so that the male terminal 320 does not stub during mating. As the male terminal 320 is slid further into the electrical terminal 20, the male terminal 320 passes through the entrance opening 50 of the contact 22. If the male terminal 320 is out of alignment during insertion, the male terminal 320 engages with a dimple 62 which serve to properly align the male terminal 320 in the passageway 134 of the contact 22.

As the male terminal 320 is slid along the passageway 134 of the contact 22, the male terminal 320 engages with the contact beams 36, 38. This causes the contact beams 36, 38 and the stiffening beams 136, 138 to flex outwardly, with the stiffening beams 136, 138 providing support for the contact beams 36, 38 since the stiffening beams 136, 138 are formed of a higher tensile material than the contact beams 36, 38. During this insertion, the rear sections 60 of the contact beams 36, 38 first flex to allow entry of the male terminal 320 and to provide an initially low insertion force. As the male terminal 320 is slid further relative to the beams 36, 136, 38, 138, the intermediate sections 58 of the contact beams 36, 38 and the sections 192 of the stiffening beams 136, 138 flex. If necessary, the front sections 56 of the contact beams 36, 38 can also flex. The beams 36, 136, 38, 138 may flex to the extent that the beams 36, 136, 38, 138 are substantially parallel to the centerlines 40, 140. During insertion of the male terminal 320 into the electrical terminal 20, the higher tensile strength material used to form the stiffening beams 136, 138 increases the normal force for proper electrical connection between the contact beams 36, 38 and the male terminal 320. Therefore, the contact beams 36, 38 can be made of a lower tensile strength material, such as copper, while ensuring that engagement is formed between the male terminal 320 and the contact beams 36, 38. The stiffening beams 136, 138 provide reinforcement to the contact beams 36, 38 and provide additional normal force to counteract the deterioration of the performance of the contact beams 36, 38 over time. In the embodiment shown, the hood 24 does not provide any direct electrical contact 22 with the male terminal 420, but the hood 24 adds greater mechanical properties to improve or enhance the electrical properties of the contact beams 36, 38.

Once the contact assembly 90, the connector assembly 1020 and the male terminal 320 are assembled together, the electrical path can be verified by appropriate testing. This is accomplished by the test probe 820 being inserted through the probe receiving passageway 656 of the front cover 622 and electrical conductivity can be checked by electrically connecting the test probe 820 to the alignment rib 214, 214' on the hood 24 of the electrical terminal 20.

In certain circumstances, the contact assembly 90 may be defective or may need to be serviced. In these circumstances, it is necessary to remove the contact assembly 90 from the connector assembly 620. To remove the contact assembly 90, the independent secondary lock 626 is first moved back from the locked position shown in FIG. 45 to the unlocked position show in FIG. 44 so that the contact assembly 90 can be withdrawn back through the independent secondary lock 626. In addition, the retention finger 674 must be deflected out of the window 236. This is accomplished by inserting the retracting tool 720 into and through the tool receiving passageway 654 and the space 658 in the front cover 622 and inserting the retracting tool 720 into the space 750 to deflect the retention finger 674. Once the retention finger 674 is withdrawn from the window 632, the contact assembly 90 can be withdrawn from the connector assembly 1020.

As the contact assembly 90 is withdrawn, the angled upper portion 242 of each rear end 146*b*, 148*b* of the side walls 146, 148 comes into contact with the seal 630. This angled upper portion 242 enlarges the passageway 704 such that tearing of the seal 630 is prevented or avoided. The seal 630 may then be reused upon reinsertion of the repaired contact assembly 90. During this withdrawal, as the seal 630 expands, the seal 630 can expand into the front recess 740 in the body 712 of the seal cover or grommet cover 632, thereby preventing the seal 630 from being pinched by the seal cover or grommet cover 632.

It should be noted that, in general, the depiction of whether the electrical terminal 20 is a plug type or a receptacle type in the figures is done merely for illustrative purposes. Therefore, it is envisioned that a particular electrical terminal 20 could be configured to be a plug type, or a receptacle type, or a combination of plug and receptacle, as desired. Therefore, unless specifically noted, the determination of whether the electrical terminal 20 is a receptacle or plug is not intended to be limiting.

By providing the two-piece electrical terminal 20, a lower cost electrical terminal 20 is provided since the entire electrical terminal 20 is not formed of the higher cost, highly conductive material.

In addition, since a high tensile strength material, such as stainless steel, is used for the hood 24, the hood 24 can be bent to include the 180-degree bends which is not possible with copper, since copper tends to crack when bent at a 180-degree bend.

The use of the terms "a" and "an" and "the" and "at least one" and similar references in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All processes described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An electrical terminal comprising:

a contact formed of a first material having a tensile strength, the contact formed of a body having a front end and a rear end, a passageway formed therethrough, and first and second contact beams extending from the body and extending into the passageway, each contact beam having a length. each contact beam being movable relative to the body; and a hood surrounding the contact, the hood formed of a second material having a tensile strength, the hood formed of a body having a front end and a rear end, a passageway formed through the body of the hood, and first and second and second stiffening beams extending from the body of the hood and extending into the passageway of the hood, each stiffening beam having a length, each stiffening beam being movable relative to the body of the hood, the first stiffening beam engaging the first contact beam and the second stiffening beam engaging the second contact beam, the hood having at least one projection forming a stop provided proximate to the front end of the body of the hood, the at least one projection extending into the passageway of the hood, the front end of the body of the contact engaging against the at least one projection, wherein at least one flange extends from the front end of the body of the hood and being forward of the at least one projection, wherein the tensile strength of the second material is greater than the tensile strength of the first material, and wherein the length of the first stiffening beam is less than the length of the first contact beam and the length of the second stiffening beam is less than the length of the second contact beam.

2. The electrical terminal of claim 1, wherein the first and second contact beams are aligned with each other and extend from the body proximate to a front end of the body of the contact.

3. The electrical terminal of claim 1, wherein the body of the hood has four walls joined together to form the passageway therethrough, and wherein the at least one flange comprises a flange extending outwardly from a front end of each wall of the body of the hood, each flange being formed of a first wall portion and a second wall portion, the second wall portion of the flange being angled at an angle of about 15 degrees to about 75 degrees relative to a centerline of the first wall portion of the flange.

4. The electrical terminal of claim 1, wherein the body of the hood has four walls joined together to form the passageway therethrough, and wherein the at least one flange comprises a flange extending outwardly from a front end of each wall of the body of the hood, each flange being formed of a first wall portion and a second wall portion, the second wall portion of the flange being angled at an angle of about 120° degrees to about 180° degrees relative to a centerline of the first wall portion of the flange.

5. The electrical terminal of claim 1, wherein the body of the contact comprises a top wall, a bottom wall and side walls extending between the top and bottom walls to form the passageway, wherein each side wall has at least one protrusion extending outwardly therefrom, and wherein the body of the hood comprises a top wall, a bottom wall and side walls extending between the top and bottom walls to form the passageway of the hood, wherein one of the side walls of the contact and the hood has a plurality of protrusions extending therefrom which seat within windows formed in the other of the side walls of the contact and the hood.

6. The electrical terminal of claim 1 claim 1, further comprising an alignment rib extending from a top surface of the body of the hood, wherein a front end of the alignment rib is spaced rearwardly from the front end of the body of the hood.

7. The electrical terminal of claim 6, wherein the front end of the alignment rib is formed by a chamfered surface.

8. The electrical terminal of claim 6, wherein the alignment rib further comprises a finger extending downwardly, and a window in the top wall of the hood, the finger extending into the window.

9. The electrical terminal of claim 6, wherein the alignment rib is formed of a front portion and a rear portion which are spaced apart from each other, wherein the front portion has a front end and a rear end, and the rear portion has a front end and a rear end, each end of the front and rear portions having a chamfered surface thereon.

10. The electrical terminal of claim 9, further comprising a window in the body of the hood, the window being provided between the front and rear portions of the alignment rib.

11. The electrical terminal of claim 1, wherein the body of the hood comprises a top wall, a bottom wall and side walls extending between the top and bottom walls to form the passageway, each side wall having a front end and a rear end, at least a portion of the rear end of each side wall being formed by a surface which is angled relative to a centerline of the body of the hood.

12. The electrical terminal of claim 11, wherein the surface of each side wall is chamfered.

13. The electrical terminal of claim 12, further comprising an alignment rib extending from the top wall proximate to the rear end of each side wall.

14. The electric terminal of claim 1, wherein the body has opposite top and bottom walls which are connected to one another by first and second upright side walls, whereby the passageway is defined between the top and bottom walls and the first and second upright side walls, wherein the first contact beam extends from the top wall and into the passageway, and wherein the second contact beam extends from the bottom wall and into the passageway.

15. The electric terminal of claim 14, wherein the top wall has a top opening formed therein, the top opening being spaced from the front end of the body of the contact, the top opening having a front edge, wherein the first contact beam extends rearwardly from the front edge of the top opening.

16. The electric terminal of claim 14, wherein the bottom wall has a bottom opening formed therein, the bottom opening being spaced from the front end of the body of the contact, the bottom opening having a front edge, wherein the second contact beam extends rearwardly from the front edge of the bottom opening.

17. An electrical terminal comprising:

a contact formed of a first material having a tensile strength, the contact formed of a body having opposite top and bottom walls which are connected to one another by first and second upright side walls, a front end and a rear end, a passageway defined between the top and bottom walls and the first and second upright side walls, and first and second contact beams extending from the body and extending into the passageway, the first contact beam extending from the top wall, the second contact beam extending from the bottom wall; and a hood surrounding the contact, the hood formed of a second material having a tensile strength, the hood formed of a body having a front end and a rear end, a passageway formed through the body of the hood, and an alignment rib extending from a top surface of the body of body of the hood, wherein the tensile strength of the second material is greater than the tensile strength of the first material.

18. The electrical terminal of claim 17, wherein the front end of the alignment rib is formed by a chamfered surface.

19. The electrical terminal of claim 17, wherein the alignment rib is formed of a front portion and a rear portion which are spaced apart from each other, wherein the front portion has a front end and a rear end, and the rear portion has a front end and a rear end, each end of the front and rear portions having a chamfered surface thereon.

20. The electric terminal of claim 17, wherein the top wall of the contact has a top opening formed therein, the top opening being spaced from the front end of the body of the contact, the top opening having a front edge, wherein the first contact beam extends rearwardly from the front edge of the top opening.

21. The electric terminal of claim 17, wherein the bottom wall of the contact has a bottom opening formed therein, the bottom opening being spaced from the front end of the body of the contact, the bottom opening having a front edge, wherein the second contact beam extends rearwardly from the front edge of the bottom opening.

22. The electrical terminal of claim 17, wherein the body of the hood comprises a top wall, a bottom wall and side walls extending between the top and bottom walls to form the passageway, each side wall having a front end and a rear end, the rear end of each side wall formed by a surface which is angled relative to a centerline of the body of the hood.

23. The electrical terminal of claim 22, wherein the surface of each side wall is chamfered.

24. The electrical terminal of claim 22, wherein a rear end of the alignment rib extends from the top wall proximate to the rear end of each side wall.

25. The electrical terminal of claim 22, wherein the rear end of the alignment rib has a chamfered surface.

26. An electrical terminal comprising:

a contact formed of a first material having a tensile strength, the contact formed of a body having a front end and a rear end, a passageway formed therethrough, and first and second contact beams extending from the body and extending into the passageway; and a hood surrounding the contact, the hood formed of a second material having a tensile strength, the hood formed of a body having a top wall, a front end and a rear end, a passageway formed through the body of the hood, and an alignment rib extending from the top wall, wherein a front end of the alignment rib is spaced rearwardly from the front end of the body of the hood, wherein the tensile strength of the second material is greater than the tensile strength of the first material, and wherein the alignment rib further comprises a finger extending downwardly, and a window in the top wall of the hood, the finger extending into the window.

27. An electrical terminal comprising:

a contact formed of a first material having a tensile strength, the contact formed of a body having a front end and a rear end, a passageway formed therethrough, and first and second contact beams extending from the body and extending into the passageway; and a hood surrounding the contact, the hood formed of a second material having a tensile strength, the hood formed of a body having a front end and a rear end, a passageway formed through the body of the hood, and an alignment rib extending from a top surface of the body of the hood, wherein a front end of the alignment rib is spaced rearwardly from the front end of the body of the hood, wherein the tensile strength of the second material is greater than the tensile strength of the first material, wherein the alignment rib is formed of a front portion and a rear portion which are spaced apart from each other, wherein the front portion has a front end and a rear end, and the rear portion has a front end and a rear end, each end of the front and rear portions having a chamfered surface thereon, and further comprising a window in the body of the hood, the window being provided between the front and rear portions of the alignment rib.

28. An electrical terminal comprising:

a contact formed of a first material having a tensile strength, the contact formed of a body having a front end and a rear end, a passageway formed therethrough, and first and second contact beams extending from the body and extending into the passageway; and a hood surrounding the contact, the hood formed of a second material having a tensile strength, the hood formed of a body having a front end and a rear end, a passageway formed through the body of the hood, and an alignment rib extending from a top surface of the body of the hood, wherein a front end of the alignment rib is spaced rearwardly from the front end of the body of the hood, wherein the tensile strength of the second material is greater than the tensile strength of the first material, and wherein each contact beam is movable relative to the body of the contact, and further comprising first and second and second stiffening beams extending from the body of the hood and extending into the passageway of the hood, each stiffening beam being movable relative to the body of the hood, the first stiffening beam engaging the first contact beam and the second stiffening beam engaging the second contact beam.

29. An electrical terminal comprising:

a contact formed of a first material having a tensile strength, the contact formed of a body having opposite top and bottom walls which are connected to one another by first and second upright side walls, a front end and a rear end, a passageway defined between the top and bottom walls and the first and second upright side walls, and first and second contact beams extending from the body and extending into the passageway, the first contact beam extending from the top wall, the second contact beam extending from the bottom wall; and a hood surrounding the contact, the hood formed of a second material having a tensile strength, the hood formed of a body comprising a top wall, a bottom wall and first and second side walls extending between the top and bottom walls and which form a passageway therethrough, each wall having a front end and a rear end formed of chamfered surfaces, and a flange extending outwardly from the front end of each wall of the body of the hood and being angled relative to the respective wall, each flange having a front end formed of chamfered surfaces, wherein the tensile strength of the second material is greater than the tensile strength of the first material.

30. The electrical terminal of claim 29, wherein each flange being formed of a first wall portion and a second wall portion, the second wall portion of the flange being angled at an angle of about 15° degrees to about 75° degrees relative to a centerline of the first wall portion of the flange.

31. The electrical terminal of claim 29, wherein each flange being formed of a first wall portion and a second wall portion, the second wall portion of the flange being angled at an angle of about 120 degrees to about 180 degrees relative to a centerline of the first wall portion of the flange.

32. The electrical terminal of claim 29, wherein the flange extending from the first side wall has a height which is less than a height of the first side wall, the flange extending from the second side wall has a height which is less than a height of the second side wall, the flange extending from the top wall has a width which is less than a width of the top wall, and the flange extending from the bottom wall has a width which is less than a width of the bottom wall.

33. The electrical terminal of claim 29, wherein the rear end of each side wall formed by a surface which is angled relative to a centerline of the body of the hood, the surface of each side wall being chamfered.

34. The electrical terminal of claim 29, further comprising an alignment rib extending from the top wall and having front and rear ends, wherein the front end of the alignment rib is spaced rearwardly from the front end of the body of the hood, the front and rear ends of the alignment rib are formed by chamfered surfaces.

35. The electrical terminal of claim 34, wherein the alignment rib is formed of a front portion and a rear portion which are spaced apart from each other, wherein the front portion has front and rear ends formed of chamfered surfaces, and the rear portion has front and rear ends formed of chamfered surfaces.

36. An electrical terminal comprising:

a contact formed of a first material having a tensile strength, the contact formed of a body having a front end and a rear end, a passageway formed therethrough, and first and second contact beams extending from the body and extending into the passageway; and a hood surrounding the contact, the hood formed of a second material having a tensile strength, the hood formed of a body comprising a top wall, a bottom wall and first and second side walls extending between the top and bottom walls and which form a passageway therethrough, each wall having a front end and a rear end formed of chamfered surfaces, and a flange extending outwardly from the front end of each wall of the body of the hood and being angled relative to the respective wall, each flange having a front end formed of chamfered surfaces, wherein the tensile strength of the second material is greater than the tensile strength of the first material, and wherein each wall further includes a projection forming a stop extending into the passageway of the hood, each projection being rearward of the flange.

37. An electrical terminal comprising:

a contact formed of a first material having a tensile strength, the contact formed of a body having a front end and a rear end, a passageway formed therethrough, and first and second contact beams extending from the body and extending into the passageway; and a hood surrounding the contact, the hood formed of a second material having a tensile strength, the hood formed of a body comprising a top wall, a bottom wall and first and second side walls extending between the top and bottom walls and which form a passageway therethrough, each wall having a front end and a rear end formed of chamfered surfaces, and a flange extending outwardly from the front end of each wall of the body of the hood and being angled relative to the respective wall, each flange having a front end formed of chamfered surfaces, wherein the tensile strength of the second material is greater than the tensile strength of the first material, further comprising an alignment rib extending from the top wall and having front and rear ends, wherein the front end of the alignment rib is spaced rearwardly from the front end of the body of the hood, the front and rear ends of the alignment rib are formed by chamfered surfaces, wherein the alignment rib further comprises a finger extending downwardly, and a window in the top wall of the hood, the finger extending into the window.

38. An electrical terminal comprising:

a contact formed of a first material having a tensile strength, the contact formed of a body having a front end and a rear end, a passageway formed therethrough, and first and second contact beams extending from the body and extending into the passageway; and a hood surrounding the contact, the hood formed of a second material having a tensile strength, the hood formed of a body comprising a top wall, a bottom wall and first and second side walls extending between the top and bottom walls and which form a passageway therethrough, each wall having a front end and a rear end formed of chamfered surfaces, and a flange extending outwardly from the front end of each wall of the body of the hood and being angled relative to the respective wall, each flange having a front end formed of chamfered surfaces, wherein the tensile strength of the second material is greater than the tensile strength of the first material, further comprising an alignment rib extending from the top wall and having front and rear ends, wherein the front end of the alignment rib is spaced rearwardly from the front end of the body of the hood, the front and rear ends of the alignment rib are formed by chamfered surfaces, wherein the alignment rib is formed of a front portion and a rear portion which are spaced apart from each other, wherein the front portion has front and rear ends formed of chamfered surfaces, and the rear portion has front and rear ends formed of chamfered surfaces, further comprising a window in the body of the hood formed by surfaces, the window being provided between the front and rear portions of the alignment rib, the surfaces forming the window being chamfered.

39. A combination comprising:

a connector assembly comprising a housing having a passageway extending therethrough, a compliant resilient seal comprising a front end and rear end and a passageway extending therethrough, the seal being rearward of the housing, and a grommet cap comprising a front end and rear end and a passageway extending therethrough, the grommet cap being rearward of the seal, the passageway of the grommet cap having a front portion extending from the front end thereof and defining a first dimension of the passageway, and a rear portion extending between the front portion and the rear end of the grommet cap and defining a second dimension of the passageway, the first dimension being greater than the second dimension; and an electrical terminal comprising a contact formed of a body having a front end and a rear end, a passageway formed therethrough, and first and second contact beams extending from the body and extending into the passageway of the contact, the contact being seated within the housing and being forward of the seal.

40. The combination of claim 39, wherein the electrical terminal further comprises a hood surrounding the contact, the hood formed of a body comprising a top wall, a bottom wall and first and second side walls extending between the top and bottom walls and which form a passageway therethrough, the contact being seated within the passageway of the hood, the hood being seated within the housing, each side wall of the hood having a front end and a rear end, the rear end of each side wall formed by a surface which is angled relative to a centerline of the body of the hood.

41. The combination of claim 40, wherein the surface of each side wall is chamfered.

42. The combination of claim 40, further comprising a lock engageable with the surfaces of the side walls, the lock being configured to be locked in position relative to the housing.

43. The combination of claim 40, wherein the lock has a front end and a rear end, the front end of the lock having surfaces which are angled relative to a centerline of the lock, the surfaces on the lock being engageable with the surfaces of the side walls, the rear end being proximate to the seal.

44. A combination comprising:

a connector assembly comprising a housing having a passageway extending therethrough, a lock configured to be locked in position relative to the housing and configured to be movable relative to the housing, the lock having a front end and a rear end, the front end of the lock having surfaces which are angled relative to a centerline of the lock, a compliant resilient seal comprising a front end and rear end and a passageway extending therethrough, the seal being rearward of the housing and the lock, and a grommet cap comprising a front end and rear end and a passageway extending therethrough, the grommet cap being rearward of the seal; and an electrical terminal comprising a contact formed of a body having a front end and a rear end, a passageway formed therethrough, and first and second contact beams extending from the body and extending into the passageway of the contact, and a hood surrounding the contact, the hood formed of a body comprising a top wall, a bottom wall and first and second side walls extending between the top and bottom walls and which form a passageway therethrough, the contact being seated within the passageway of the hood, the hood being seated within the housing and forward of the seal, each side wall of the hood having a front end and a rear end, the rear end of each side wall formed by a surface which is angled relative to a centerline of the body of the hood, wherein the surfaces on the lock are engageable with the surfaces of the side walls.

* * * * *